US011718884B1

(12) United States Patent
McCoy et al.

(10) Patent No.: US 11,718,884 B1
(45) Date of Patent: Aug. 8, 2023

(54) SYSTEM AND METHOD FOR FRESH BOVINE HIDE SPLITTING

(71) Applicant: Scientific Life Solutions, LLC, Bloomington, MN (US)

(72) Inventors: Bart McCoy, Omaha, NE (US); Wade Rosen, Minneapolis, MN (US)

(73) Assignee: Scientific Life Solutions, LLC, Bloomington, MN (US)

( * ) Notice: Subject to any disclaimer, the term of this patent is extended or adjusted under 35 U.S.C. 154(b) by 0 days.

(21) Appl. No.: 17/878,367

(22) Filed: Aug. 1, 2022

Related U.S. Application Data

(63) Continuation of application No. 17/175,992, filed on Feb. 15, 2021, now Pat. No. 11,459,625.

(51) Int. Cl.

| | |
|---|---|
| ***C14B 1/18*** | (2006.01) |
| ***C14B 1/16*** | (2006.01) |
| ***C14B 1/58*** | (2006.01) |
| ***C14B 1/34*** | (2006.01) |

(52) U.S. Cl.
CPC ..... *C14B 1/18* (2013.01); *C14B 1/16* (2013.01); *C14B 1/34* (2013.01); *C14B 1/58* (2013.01); *C14B 2700/013* (2013.01); *C14B 2700/07* (2013.01); *C14B 2700/12* (2013.01)

(58) Field of Classification Search
CPC .... C14B 1/18; C14B 1/34; C14B 1/58; C14B 2700/13; C14B 2700/07; C14B 2700/12
See application file for complete search history.

(56) References Cited

U.S. PATENT DOCUMENTS

| | | | |
|---|---|---|---|
| 12,114 | A | 12/1854 | Pratt |
| 667,271 | A | 2/1901 | Webster |
| 855,576 | A | 6/1907 | Hertig |
| 1,115,059 | A | 10/1914 | Eaton et al. |
| 1,214,683 | A | 2/1917 | Johnson |
| 1,450,407 | A | 4/1923 | Bradford et al. |

(Continued)

FOREIGN PATENT DOCUMENTS

| | | | |
|---|---|---|---|
| DE | 2636319 | A1 | 5/1977 |
| DE | 19903308 | A1 | 8/2000 |

(Continued)

OTHER PUBLICATIONS

F Makelele Bwirhonde et al., Evaluation of protein and mineral nutrients in cattle hide scraps used for treating children with kwashiorkor in Bukavu, MedCrave, Journal of Nutritional Health & Food Engineering, vol. 8 Issue I, Feb. 5, 2018, 5 pages.

(Continued)

*Primary Examiner* — Shaun R Hurley
(74) *Attorney, Agent, or Firm* — Suiter Swantz pc llo

(57) ABSTRACT

A system and method for fresh bovine hide splitting includes a hide splitting machine configured to split a fresh bovine hide into a top grain and a collagen sheet. The top grain may be used for leather products. The collagen sheet may be processed with at least one of a maceration process or a drying process to produce a fresh bovine hide raw material product without the addition of a liming or bluing process. The fresh bovine hide raw material product may not include residues remaining following a liming process or bluing process. The fresh bovine hide raw material product may be usable in downstream products for human consumption including gelatin.

20 Claims, 12 Drawing Sheets

(56) References Cited

U.S. PATENT DOCUMENTS

| | | | | |
|---|---|---|---|---|
| 2,031,872 | A | 2/1936 | Morris | |
| 3,413,130 | A | 11/1968 | Rose | |
| 3,525,628 | A | 8/1970 | Cohly | |
| 6,092,301 | A | 7/2000 | Komanowsky | |
| 9,109,326 | B2 | 8/2015 | Shinbayashi | |
| 2004/0244721 | A1* | 12/2004 | Tepper | A23K 50/40 119/710 |
| 2005/0252350 | A1 | 11/2005 | Derricott | |
| 2010/0119658 | A1* | 5/2010 | Levin | A23K 10/26 426/445 |
| 2021/0254187 | A1 | 8/2021 | Aota et al. | |

FOREIGN PATENT DOCUMENTS

| | | | |
|---|---|---|---|
| EP | 3366786 | B1 | 3/2019 |
| GB | 1210549 | A | 10/1970 |
| GB | 2335437 | B | 9/2002 |
| JP | 2002249982 | A | 9/2002 |
| WO | 2020059038 | A1 | 3/2020 |

OTHER PUBLICATIONS

Michael Black et al., Best Available Techniques (BAT) Reference Document for the Tanning of Hides and Skins, European Commission, JRC Reference Reports, Industrial Emissions Directive 2010/75/EU (Integrated Pollution Prevention and Control), 2013, 295 pages.

* cited by examiner

SYSTEM AND METHOD FOR FRESH BOVINE HIDE SPLITTING

CROSS REFERENCE TO RELATED APPLICATION

The present application claims the benefit of U.S. patent application Ser. No. 17/175,992, filed on Feb. 15, 2021, titled SYSTEM AND METHOD FOR FRESH BOVINE HIDE SPLITTING, naming Bart Mccoy and Wade Rosen as inventors, which is incorporated herein by reference in the entirety.

TECHNICAL FIELD

The present invention in general relates to the field of animal hides, and, more particularly, to a system and method for fresh bovine hide splitting.

BACKGROUND

Hide splitting machines for making leather separate a hide into a top grain and a collagen sheet. The hide may be limed or blued to preserve it after being removed from an animal and before splitting. Limed or blued bovine hides include chemicals that may alter the bovine hide. For example, the chemicals may reduce the quality of the top grain and/or the collagen sheet. By way of another example, the chemicals may be harmful to the hide splitting machines, to the environment, and/or to consumers using products generated from the top grain and/or the collagen sheet.

As such, it would be advantageous to provide a system and method to remedy shortcomings of the approaches identified above.

SUMMARY

A system for fresh bovine hide splitting is disclosed, in accordance with one or more embodiments of the present disclosure. In one embodiment, the system for fresh bovine hide splitting may include a hide splitting machine. In another embodiment, the hide splitting machine may include at least one apron plate. In another embodiment, the hide splitting machine may include at least one gauge roll support positioned within a cavity defined by the at least one apron plate. In another embodiment, the hide splitting machine may include at least one gauge roll proximate to the at least one gauge roll support. In another embodiment, the hide splitting machine may include at least one ring roll positioned below the at least one gauge roll. The at least one gauge roll and the at least one ring roll may share a center plane through respective center axes. In another embodiment, the hide splitting machine may include at least one rubber roll proximate to the at least one ring roll. In another embodiment, the hide splitting machine may include at least one knife at least partially positioned within at least one knife jaw. A distance between an outer edge of the at least one knife jaw may be between 13.00 mm and 15.00 mm from the center plane. The hide splitting machine may be configured to receive a fresh bovine hide via a feed opening. The at least one knife may be configured to split the fresh bovine hide into a top grain and a collagen sheet. The collagen sheet may have a calcium residue of less than 0.33% by total wet weight. The top grain may be between 0.50 and 5.50 mm in thickness.

A method for fresh bovine hide splitting is disclosed, in accordance with one or more embodiments of the present disclosure. In one embodiment, the method may include, but is not limited to, setting up a hide splitting machine. In another embodiment, the hide splitting machine may include at least one apron plate. In another embodiment, the hide splitting machine may include at least one gauge roll support positioned within a cavity defined by the at least one apron plate. In another embodiment, the hide splitting machine may include at least one gauge roll proximate to the at least one gauge roll support. In another embodiment, the hide splitting machine may include at least one ring roll positioned below the at least one gauge roll. The at least one gauge roll and the at least one ring roll may share a center plane through respective center axes. In another embodiment, the hide splitting machine may include at least one rubber roll proximate to the at least one ring roll. In another embodiment, the hide splitting machine may include at least one knife at least partially positioned within at least one knife jaw. A distance between an outer edge of the at least one knife jaw may be between 13.00 mm and 15.00 mm from the center plane. In another embodiment, the method may include, but is not limited to, splitting a fresh bovine hide into a top grain and a collagen sheet with the hide splitting machine. The collagen sheet may have a calcium residue of less than 0.33% by total wet weight. The top grain may be between 0.50 and 5.50 mm in thickness.

A fresh bovine hide raw material product is disclosed, in accordance with one or more embodiments of the present disclosure. In one embodiment, the fresh bovine hide raw material product may have a water activity less than 0.7 w and a calcium residue of less than 0.33% by total wet weight. In another embodiment, the fresh bovine hide raw material product may be produced from a collagen sheet split from a fresh bovine hide and at least one of macerated or dried.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present disclosure may be better understood by those skilled in the art by reference to the accompanying figures in which.

DETAILED DESCRIPTION

Figure 1A:
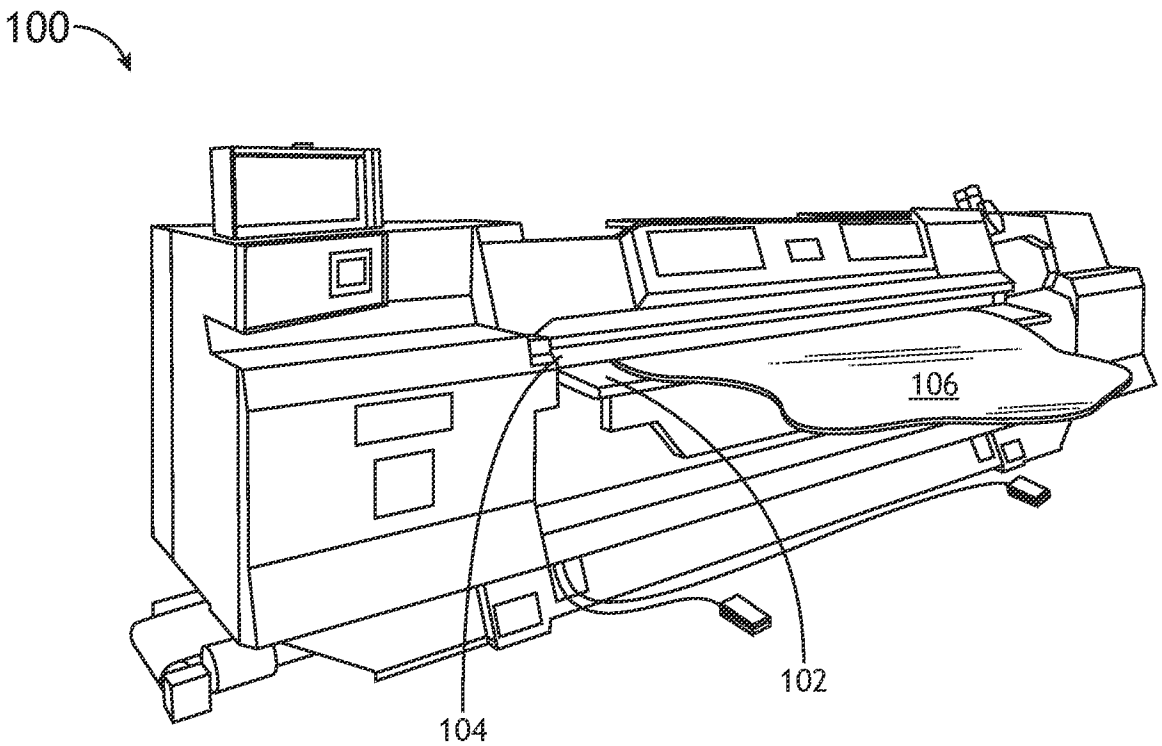
FIG. 1A is a perspective view of a hide splitting machine, in accordance with one or more embodiments of the present disclosure.

The present disclosure has been particularly shown and described with respect to certain embodiments and specific features thereof. The embodiments set forth herein are taken to be illustrative rather than limiting. It should be readily apparent to those of ordinary skill in the art that various changes and modifications in form and detail may be made without departing from the spirit and scope of the present disclosure. Reference will now be made in detail to the subject matter disclosed, which is illustrated in the accompanying drawings.

Referring in general to FIGS. 1A-6, a system and method for fresh bovine hide splitting is described, in accordance with one or more embodiments of the present disclosure.

Hide splitting machines for making leather separate a bovine hide into a top grain and a collagen sheet. The bovine hide may be limed or blued to preserve it after being removed from an animal and before splitting. Limed or blued bovine hides include chemicals that may alter the bovine hide. For example, the chemicals may reduce the quality of the top grain and/or the collagen sheet. By way of another example, the chemicals may be harmful to the hide splitting machines, to the environment, and/or to consumers using products generated from the top grain and/or the collagen sheet.

For purposes of the present disclosure, "fresh bovine hide" is defined a bovine hide with no chemical modifications/interventions to the raw product as removed from the live animal post mortem. In addition, for purposes of the present disclosure, "dry bovine hide" is defined as a fresh bovine hide that has been made devoid of moisture and has highly reduced water activity levels. Further, for purposes of the present disclosure, "limed bovine hide" is defined as a bovine hide that has been exposed to calcium hydroxide, sulfides, and other dehairing enzymes. Further, for purposes of the present disclosure, "blued bovine hide" is defined as a bovine hide that has been limed and then further exposed to chromium salts in order to 'fix' or molecularly bind collagen fibers together, or a bovine hide exposed directly to chromium salts without a liming step. Further, for purposes of the present disclosure, a dry treated bovine hide is a treated hide (e.g., a limed hide or blued hide) that has been dried.

For purposes of the present disclosure, "bovine" includes any animal of the family Bovidae and its subfamilies (e.g., Bovinae, or the like) and subtribes (e.g., *Bovina*, or the like) including, but not limited to, cattle (e.g., *Bos taurus*), American bison or buffalo (e.g., Bos bison), or the like, as well as hybrids of the family Bovidae and its subfamilies and subtribes.

Embodiments of the present disclosure are directed to a system and method for fresh bovine hide splitting. Specifically, embodiments of the present disclosure are directed to system parameters to allow for the working of fresh bovine hides in place of limed or blued bovine hides. In addition, embodiments of the present disclosure are directed to methods of preparing the fresh bovine hide prior to separation, inserting the fresh bovine hide into a hide splitting machine, and removal of a top grain and a collagen sheet from the hide splitting machine after separation. Further, embodiments of the present disclosure are directed to downstream products produced from the top grain and/or the collagen sheet. Further, embodiments of the present disclosure are directed to reduced cost and/or environmental impact by splitting fresh bovine hides instead of limed or blued hides.

Figure 1B:
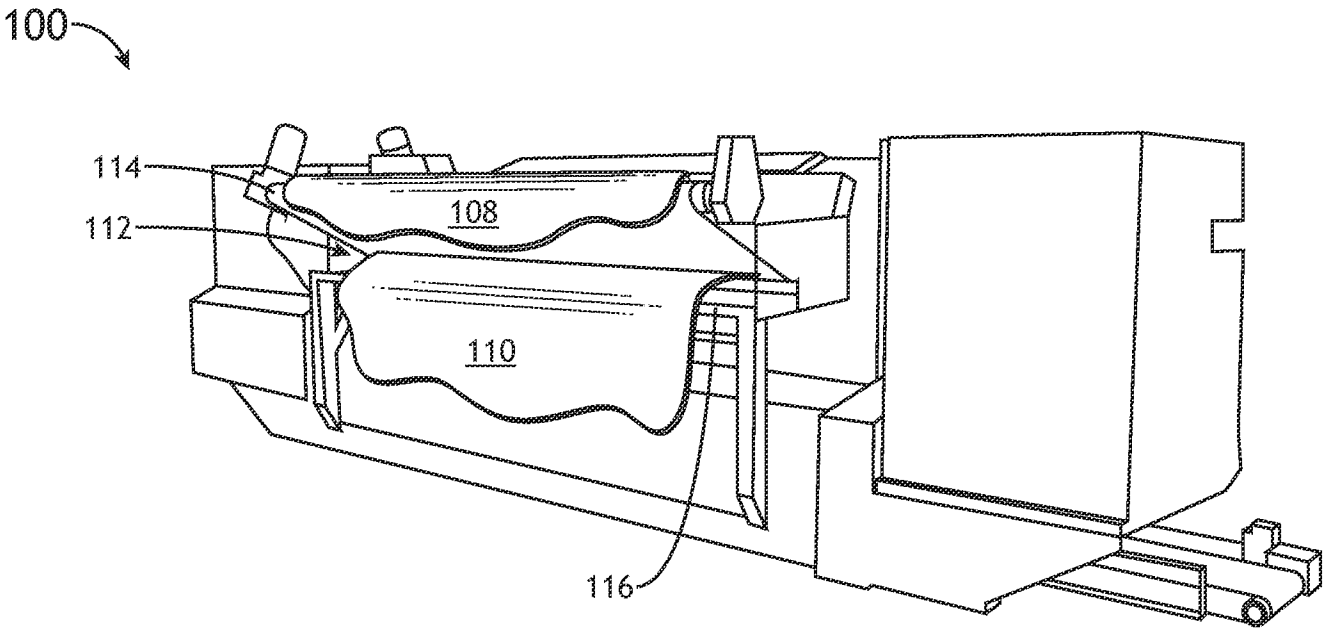
FIG. 1B is a perspective view of a hide splitting machine, in accordance with one or more embodiments of the present disclosure.

FIGS. 1A and 1B in general illustrate perspective views of a hide splitting machine 100, in accordance with one or more embodiments of the present disclosure.

In one embodiment, the hide splitting machine 100 includes a feed shelf 102 leading to a feed opening 104. In another embodiment, a portion of a fresh bovine hide 106 is placed on the feed shelf 102 and flattened (e.g., by smoothing, unfolding, or the like) to be fed into the feed opening 104. In another embodiment, the fresh bovine hide 106 is fed into the feed opening 104, while maintaining its flattened state along the length of the fresh bovine hide 106. It is noted herein the feed shelf 102 may be a table separate from and positioned proximate to the hide splitting machine 100. For purposes of the present disclosure, the hide splitting machine 100 is understood to be usable with the fresh bovine hides 106, where the fresh bovine hides 106 are being split. It is contemplated, however, the hide splitting machine 100 is not limited to the fresh bovine hides 106, and may be usable with any animal hides capable of being inserted into the feed opening 104.

Figure 1C:
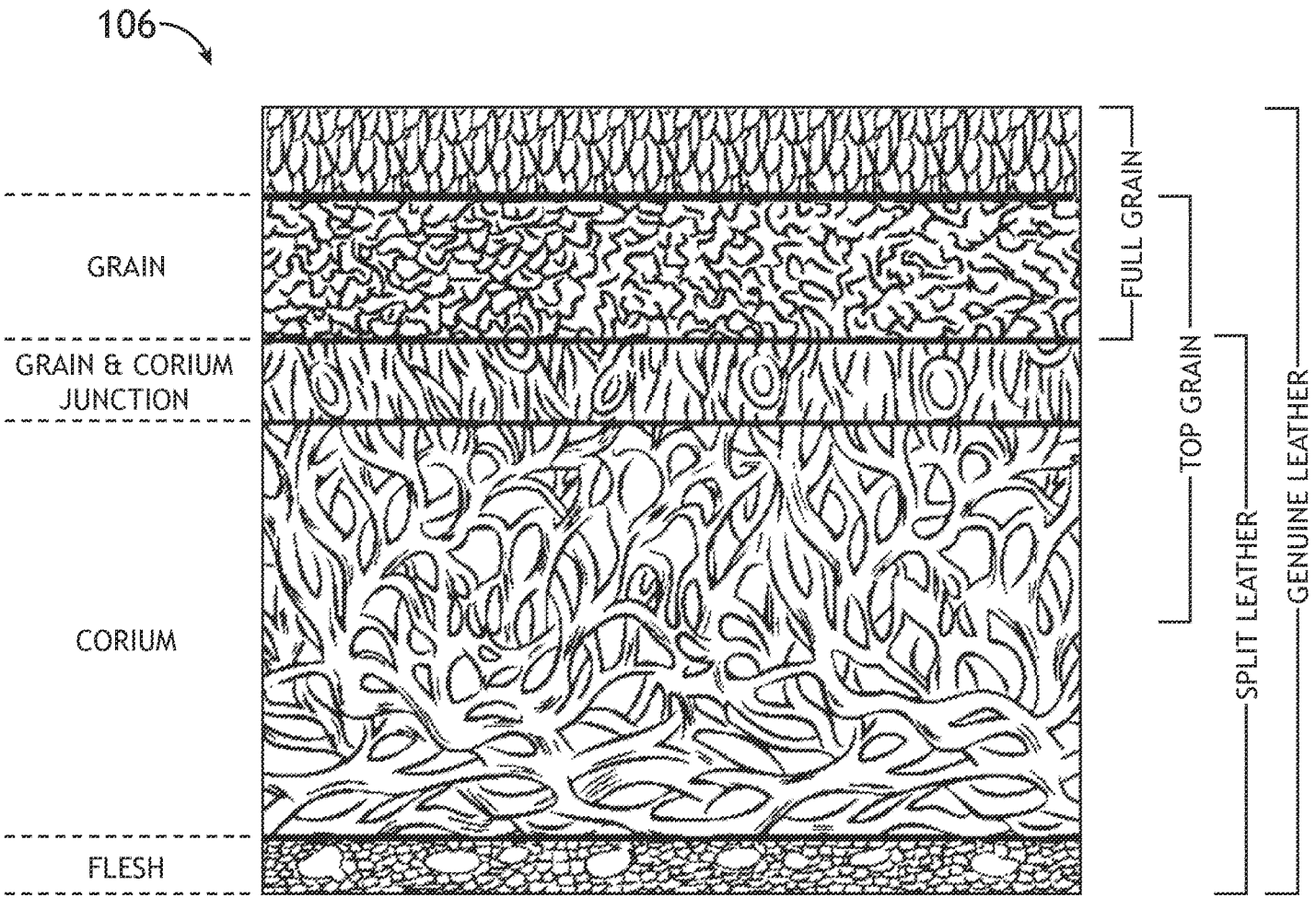
FIG. 1C is a simplified schematic of a cross-section of a fresh bovine hide, in accordance with one or more embodiments of the present disclosure.

In another embodiment, the fresh bovine hide 106 is split into a top grain 108 and a collagen sheet 110 (e.g., at least one split layer) after entering the feed opening 104. It is noted herein FIG. 1C illustrates a simplified schematic of a cross-section of the fresh bovine hide 106, in accordance with one or more embodiments of the present disclosure.

In another embodiment, the top grain 108 includes a grain, a grain and corium junction, and a portion of the corium (e.g., the top epidural layer). It is noted herein the top grain 108 may include hair as opposed to a limed, or limed and blued bovine hide that has been chemically treated (e.g., with an aldehyde or chromium process, with lye (e.g., sodium hydroxide, calcium hydroxide, or the like), with sulfides or dehairing enzymes, or the like) which may remove the hair through a "burning" process and/or a depilating process. In addition, it is noted herein the top grain 108 may include hair follicles that are in the grain or the grain and corium junction, while the hair follicles may remain in a limed or blued bovine hide that has been chemically treated as the top epidural layer remains in place (e.g., which causes a lower collagen percentage being usable in the limed or blued bovine hide, as the top epidural layer is more fibrous). In another embodiment, depending on a splitting thickness applied to the fresh bovine hide 106, the top grain 108 is a full grain. It is noted herein a full grain is understood as a layer with only the grain (and potentially hair) and not including the portion of the corium and the grain and corium junction, for purposes of the present disclosure.

In another embodiment, the collagen sheet 110 includes a portion of the corium. It is noted herein the collagen sheet 110 may include some amount of flesh that remains after initial processing, though it is contemplated the bovine hide is fleshed at least once prior to being inserted into the hide splitting machine 100.

In another embodiment, the top grain 108 is removed from the hide splitting machine 100 via a first exit 112 in an opposite side of the hide splitting machine 100 from a side including the feed shelf 102 and the feed opening 104. In another example, the first exit 112 leads to a conveyor assembly 114. For example, the conveyor assembly 114 may be set at an upward angle (e.g., greater than 0 degrees) relative to a feed angle of the fresh bovine hide 106. For instance, the upward angle may cause the top grain 108 to be rolled up after passing through the first exit 112 and prior to removal from the hide splitting machine 100. It is noted herein, however, the top grain 108 may be removed from the hide splitting machine 100 via the conveyor assembly 114 in a flattened state, passing directly onto the conveyor assembly 114 from the first exit 112. It is noted herein the conveyor assembly 114 may be coupled to the hide splitting machine 100 or may be positioned proximate to the hide splitting machine 100.

In another embodiment, the collagen sheet 110 is removed from the hide splitting machine 100 via a second exit 116. For example, the second exit 116 may be positioned below the first exit 112 and/or the conveyor assembly 114, on the opposite side of the hide splitting machine 100 from the feed shelf 102 and the feed opening 104. In another embodiment, the collagen sheet 110 is deposited on a factory floor or on a surface above the factory floor. For example, the surface above the factory floor may be a table, an exit shelf, a second conveyor assembly, or other component positioned proximate to the hide splitting machine 100. It is noted herein the first exit 112 and the second exit 116 may be different exits or the same exit, depending on the dimensions of the opening (or openings) forming the first exit 112 and the second exit 116 and the proximate relationship of the first exit 112 and the second exit 116 relative to internal components of the hide splitting machine 100.

It is noted herein an automatic extractor may be used for either the top grain 108 and/or the collagen sheet 110 post-splitting of the fresh bovine hide 106, similar to a limed bovine hide. In addition, it is noted herein layers split from a wet blued bovine hide or a dry bovine hide may be removed via manual detaching or a standard conveyor belt.

Although embodiments of the present disclosure illustrate splitting the fresh bovine hide 106 into the top grain 108 and the collagen sheet 110, it is noted herein the fresh bovine hide 106 may be skived with the hide splitting machine 100, with the fresh bovine hide 106 inserted corium-side up and thin layers of the full grain, the grain, and/or the top grain 108 being cut off from the corium side. As such, it should be understood the present disclosure is also applicable to skiving the fresh bovine hide 106, and the resultant collagen sheet 110 and/or layers of grain which may be split from the fresh bovine hide 106.

Figure 2A:
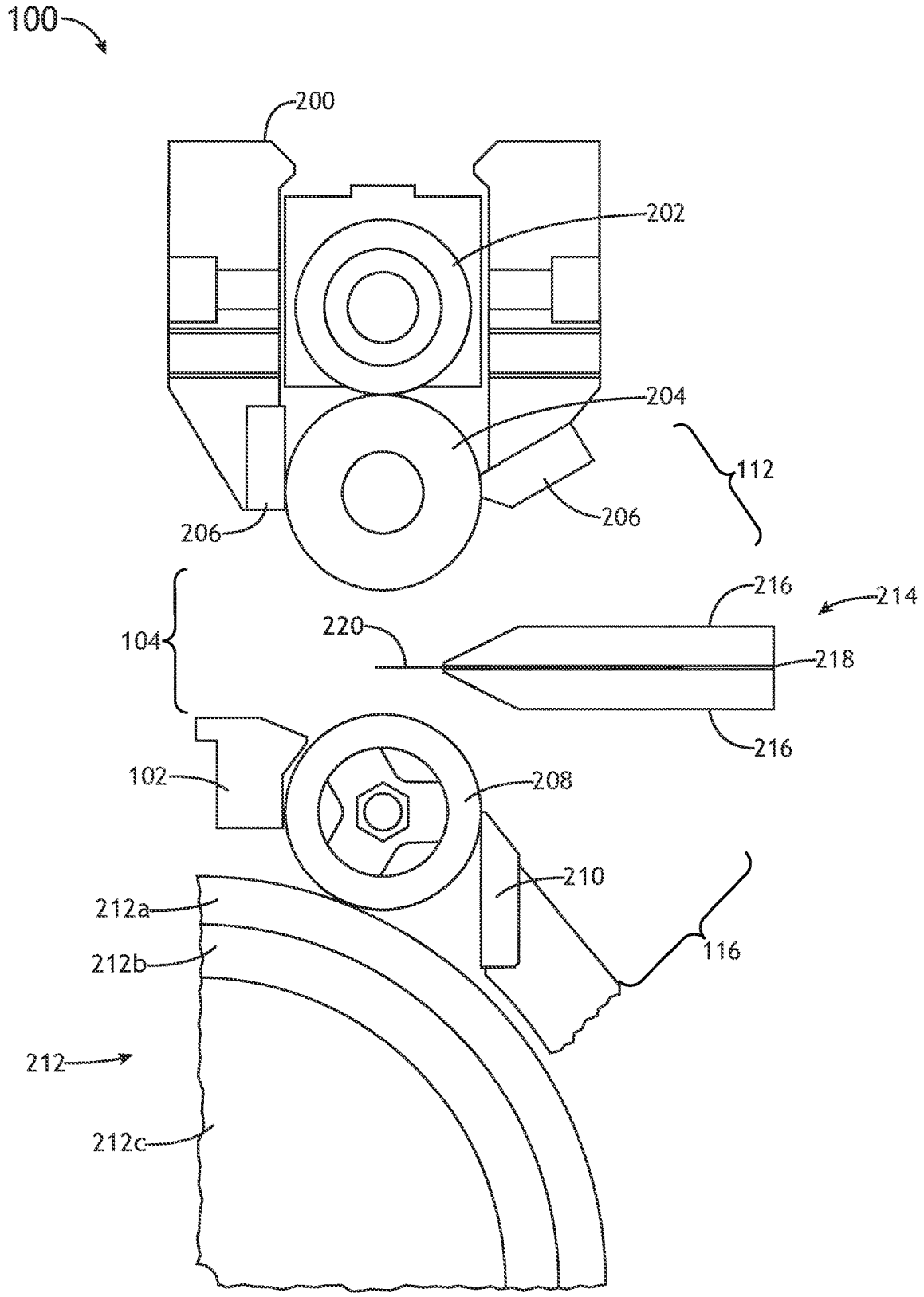
FIG. 2A is simplified block diagram of a cross-section of a hide splitting machine, in accordance with one or more embodiments of the present disclosure.
Figure 2B:
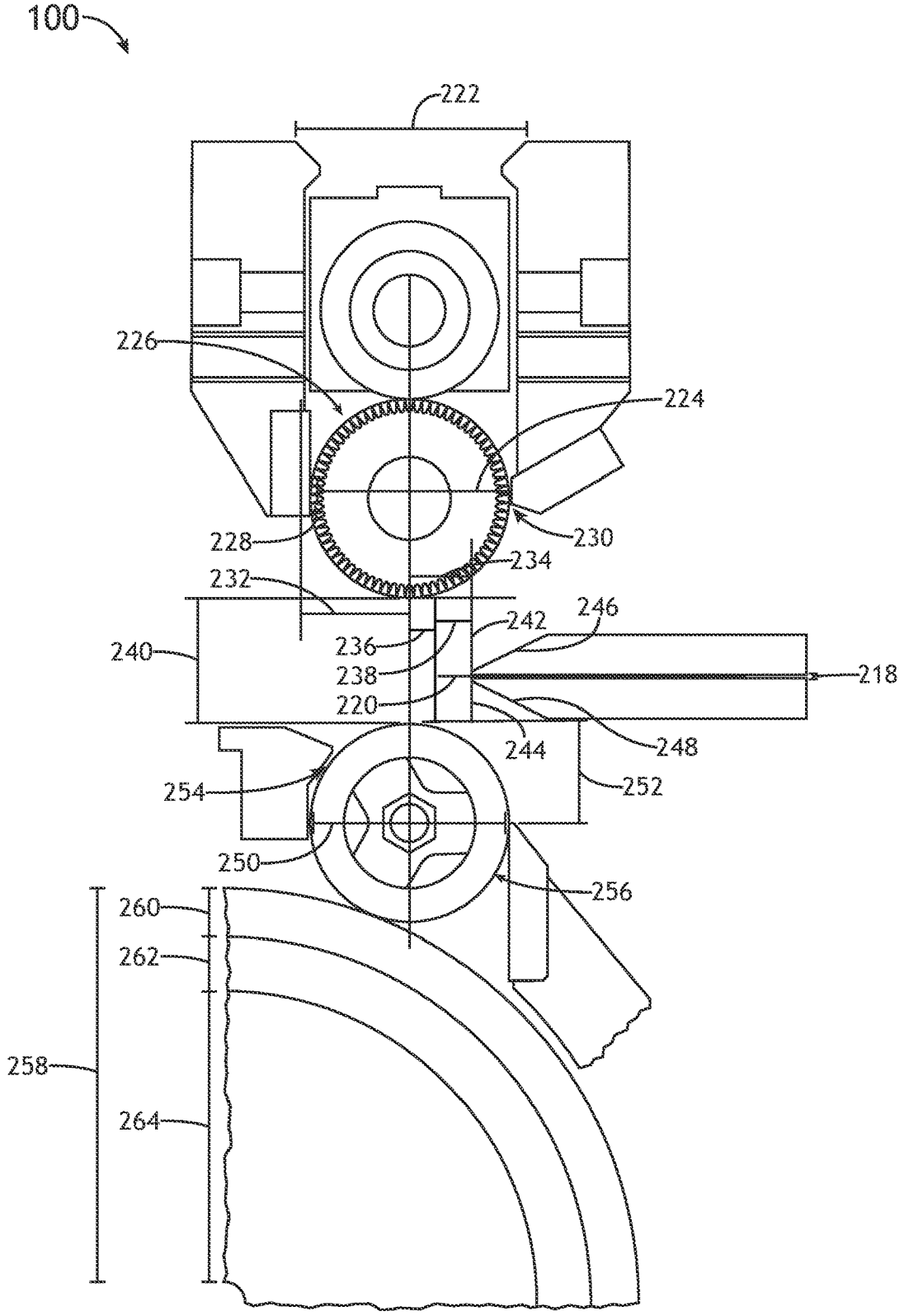
FIG. 2B is simplified block diagram of a cross-section of a hide splitting machine, in accordance with one or more embodiments of the present disclosure.
Figure 2C:
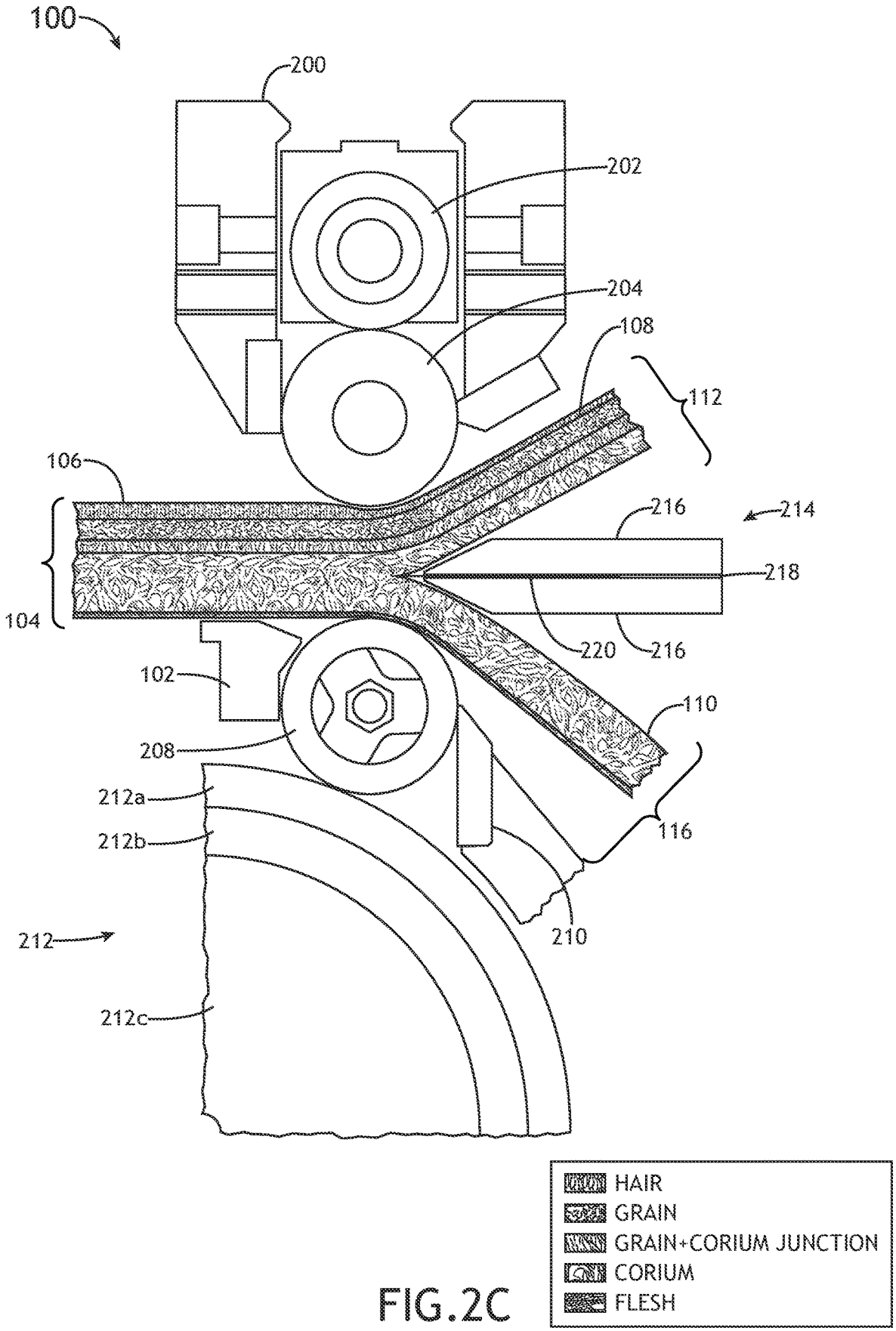
FIG. 2C is simplified block diagram of a cross-section of a hide splitting machine, in accordance with one or more embodiments of the present disclosure.

FIGS. 2A-2C in general illustrate a simplified block diagram of a cross-section of the hide splitting machine 100, in accordance with one or more embodiments of the present disclosure. It is noted herein that any reference number within FIGS. 2A-2C should be understood as applying to a corresponding component in each of FIGS. 2A, 2B, and 2C.

In one embodiment, the hide splitting machine 100 includes one or more apron plates 200. In another embodiment, the hide splitting machine 100 includes one or more gauge roll supports 202. In another embodiment, the one or more gauge roll supports 202 are proximate to the one or more apron plates 200. For example, the hide splitting machine 100 may include a single apron plate 200, to which the one or more gauge roll supports 202 may be positioned proximate. For instance, the one or more gauge roll supports 202 may be positioned within a cavity defined by the single apron plate 200. By way of another example, the hide splitting machine 100 may include a set of apron plates 200. For instance, the one or more gauge roll supports 202 may be positioned within a cavity defined by the set of apron plates 200.

In one embodiment, the hide splitting machine 100 includes one or more gauge rolls 204. For example, the hide splitting machine 100 may include a single, full-length gauge roll 204. By way of another example, the hide splitting machine 100 may include multiple gauge rolls 204. In another embodiment, the one or more gauge rolls 204 is proximate to (and in contact with, in select embodiments) the one or more gauge roll supports 202. For example, the hide splitting machine 100 may include, but is not limited to, seven gauge roll supports 202 disposed along a length of a single gauge roll 204.

It is noted herein one or more operating parameters and/or one or more dimensions of the one or more gauge rolls 204 may be adjustable depending on the bovine hide to be split, as described or illustrated throughout the present disclosure. In addition, it is noted herein the one or more gauge rolls 204 may be a longer-lasting component configured to last a few months. For example, the one or more gauge rolls 204 may be fabricated from a metallic stainless steel configured to last between 3000 and 5000 working hours.

In another embodiment, the hide splitting machine 100 includes one or more apron inserts 206 proximate to the one or more gauge rolls 204. In another embodiment, the one or more apron inserts 206 surround the one or more gauge rolls 204, and are positioned proximate to the feed opening 104 and the first exit 112. It is noted herein the one or more apron inserts 206 may be a wearable component configured to last a few weeks. For example, the one or more apron inserts 206 may be fabricated from brass or other soft metal.

In another embodiment, the hide splitting machine 100 includes one or more ring rolls 208 spaced a select distance from the one or more gauge rolls 204. It is noted herein one or more operating parameters and/or one or more dimensions of the one or more gauge rolls 204 may be adjustable depending on usage or application, as described or illustrated throughout the present disclosure. In addition, it is noted herein the one or more ring rolls 208 may be a longer-lasting component configured to last a few months. For example, the one or more ring rolls 208 may be fabricated from a chrome-coated steel.

In another embodiment, the one or more ring rolls 208 are motorized to assist in splitting fresh bovine hides 106. It is noted herein the one or more ring rolls 208 may be motorized for limed bovine hides. In addition, it is noted herein the one or more ring rolls 208 may not be motorized for wet blue bovine hides and dry treated bovine hides.

In another embodiment, the hide splitting machine 100 includes one or more ring jaws 210 proximate to the one or more ring rolls 208. In another embodiment, the one or more ring jaws 210 are positioned proximate to the second exit 116, on a side of the one or more ring rolls 208 opposite the feed shelf 102.

In another embodiment, the hide splitting machine 100 includes one or more rubber rolls 212. It is noted herein one or more operating parameters and/or one or more dimensions of the one or more rubber rolls 212 may be adjustable depending on usage or application, as described or illustrated throughout the present disclosure. In addition, it is noted herein the one or more gauge rolls 204 may be a component configured to provide a correct amount of counter-force to a dragging effect caused by the knife assembly 214 on the fresh bovine hide 106 as it passes through a work area between the one or more gauge rolls 204 and the one or more ring rolls 208 to become the top grain 108 and the collagen sheet 110, preventing bunching in the direction of knife rotation (e.g., clockwise direction) and allowing the fresh bovine hide 106 to stay open. For example, the one or more rubber rolls 212 may be fabricated with a metal inner core 212*c* (e.g., steel, or the like) in addition to or instead of one or more layers 212*a*, 212*b*. By way of another example, the one or more rubber rolls 212 may be fabricated with one or more plastic or rubber (e.g., neoprene, or the like) layers 212*a*, 212*b*. For instance, the one or more rubber rolls 212 may include a layer 212*a* with a hardness ranging from 48-46 Shore A hardness (Sha) and a layer 212*b* with a hardness ranging from 44-42 Sha.

It is noted herein limed bovine hides and fresh bovine hides 106 with hair may require one or more rubber rolls 212 with a hardness ranging from 45-43 Sha, but that wet blue bovine hides may require one or more rubber rolls 212 with a hardness ranging from 49-47 Sha and dry treated bovine hides may require one or more rubber rolls 212 with a hardness ranging from 65-60 Sha. However, it is noted herein the dual-core layers 212*a*, 212*b* may be used during the splitting of the fresh bovine hides 106 with hair due to variances in the fresh bovine hides 106. For example, heavier and/or thicker fresh bovine hides may need softer rubber rolls 212 than lighter and/or thinner fresh bovine hides. If a rubber roll 212 is too soft, however, a splitting thickness for the fresh bovine hide is too thin and scraping of the top grain may occur. In addition, if the rubber roll 212 is too hard, the splitting thickness for the fresh bovine hide is too thick and too much corium (and/or grain and corium junction) may be taken with the top grain 108.

In another embodiment, the hide splitting machine 100 includes a knife assembly 214.

In another embodiment, the knife assembly 214 includes one or more upper knife jaws 216 and one or more corresponding lower knife jaws 216, each corresponding set of upper knife jaw 216 and lower knife jaw 216 being separated by a gap 218.

In another embodiment, the knife assembly 214 includes one or more knives 220. For example, the one or more knives 220 may be a single rotating band knife configured to run perpendicular, substantially perpendicular, or offset to the direction of bovine hide feed. It is noted herein the rotation of the band knife may be complementary to the rotation of the one or more gauge rolls 204 and/or the one or more ring rolls 208 so as to counter the force exerted by friction caused by the helical grooves of the one or more gauge rolls 204. It is noted herein one or more operating parameters and/or one or more dimensions of the one or more knives 220 may be adjustable depending on usage or application, as described or illustrated throughout the present disclosure.

It is noted herein water or another fluid considered safe for downstream products (e.g., collagen sheet-based products for consumption) may be supplied to the hide splitting machine 100, similar to limed bovine hides. For example, the fluid considered safe for downstream products may act as a lubricant to the fresh bovine hide 106 as it is fed through the hide splitting machine 100 to assist in the bovine hide splitting process (e.g., by preventing hair from getting trapped in the one or more gauge rolls 204) and/or to protect wearable components within the hide splitting machine 100 (e.g., by cleaning the components within the hide splitting machine 100, cooling the components within the hide splitting machine 100, or the like). In contrast, it is noted herein diesel oil may be used as a lubricant with wet blued bovine hides and oil may be used as a lubricant with dry treated bovine hides, neither of which may be considered safe for downstream consumer products.

During the splitting of the fresh bovine hide 106, one or more parameters of the hide splitting machine 100 may be configured with settings specific to the fresh bovine hide 106, as compared to the settings used for limed or blued bovine hides. It is noted herein all of the following settings (or setting ranges) are in millimeters (mm), unless otherwise noted.

In one embodiment, the one or more gauge roll supports 202 may be a select width 222. For example, the width 222 may be any value with a range between 45.00 and 85.00 mm. For instance, the width 222 may be 48.25 mm.

In another embodiment, the one or more gauge rolls 204 include a select diameter 224. For example, the diameter 224 may be any value within a range between 45.00 mm and 85.00 mm. For instance, the diameter 224 may be 55.00 mm. In another embodiment, the one or more gauge rolls 204 include one or more grooves 226, each groove including a select depth and select cut, where the number of grooves 226 and depth of grooves 226 may be dependent on the amount of compression needed for the fresh bovine hide 106 (e.g., resulting in friction or grip on the fresh bovine hide 106). For example, the one or more grooves 226 may be spiral-machined with a V-type cut. By way of another example, the one or more gauge rolls 204 may include a number of grooves 226 ranging from 35 grooves to 100 grooves, with the grooves 226 being any value within a range between 0.10 mm and 5.50 mm in depth. For instance, the one or more gauge rolls 204 may include grooves 226, with the grooves 226 being any value within a range between 0.30 mm and 1.30 mm in depth. Further, the one or more gauge rolls 204 may include 75 grooves with a 0.70 mm depth. It is noted herein the diameter 224 and/or the number/depth of grooves 226 may be dependent on or independent of a length of the one or more gauge rolls 204. In addition, it is noted herein a limed bovine hide may include grooves being any value within a range between 0.70 mm and 1.30 mm in depth. Further, it is noted herein a wet blue split bovine hide may include grooves being any value within a range between 0.40 mm and 0.60 mm in depth. Further, it is noted herein, a dry treated split bovine hide may include a smooth gauge roll 204, without grooves 226.

It is noted herein the one or more grooves 226 positioned around the circumference of the gauge roll 224 as illustrated in FIG. 2B should not be understood as limiting with respect to the number of grooves 226 of the gauge roll 224.

In another embodiment, the hide splitting machine 100 includes a tolerance gap 228 between a front apron insert 206 and the one or more gauge rolls 204. For example, the tolerance gap 228 may be any value within a range between 0.00 mm and 0.10 mm. For instance, the tolerance gap 228 may be 0.05 mm.

In another embodiment, the hide splitting machine 100 includes a tolerance gap 230 between a rear apron insert 206 and the one or more gauge rolls 204. For example, the tolerance gap 230 may be any value within a range between 0.00 mm and 0.10 mm. For instance, the tolerance gap 230 may be 0.00 mm, or flush or substantially flush against the one or more gauge rolls 204. It is noted herein the tolerance gap 230 may need to be flush or substantially flush to prevent portions from the top grain 108 from entering the internal portions of the hide splitting machine 100 outside of the work area.

In another embodiment, the hide splitting machine 100 includes a distance 232 from an interior sidewall of the one or more apron plates 200 and a center plane connecting the center axes of the one or more gauge rolls 204 and the one or more ring rolls 208. For example, the distance 232 may be any value within a range between 22.50 mm and 37.50 mm. For instance, the distance 232 may be 32.50 mm. In this regard, the one or more apron inserts 206 may extend into the cavity defined by the sidewall of the one or more apron plates 200 a select distance to create the tolerance gaps 228, 230 with the one or more gauge rolls 204.

In another embodiment, the hide splitting machine 100 includes a distance 234 from the center of work area (e.g., as defined by a line passing through a center point of the gauge roll 204 and a ring roll 208) to an end or outer edge or tip of the one or more knife jaws 216 (e.g., where the knife 220 exits the one or more knife jaws 216). For example, the distance 234 may be any value within a range between 13.00 mm and 15.00 mm. For instance, the distance 234 may be 14.00 mm. In another embodiment, the distance 234 may be further defined as a combination of a distance 236 from the center of work area and the knife 220 edge, and a distance 238 from the knife 220 edge to the end of the one or more knife jaws 216 representing an amount the knife 220 protrudes from the end of the one or more knife jaws 216. For example, the distance 236 may be any value within a range between 4.00 mm and 9.00 mm, and the distance 238 may be any value within a range between 6.00 mm and 9.00 mm. For instance, the distances 236, 238 may each be 7.00 mm, a different setup as compared to limed or blued processing for the two distances 236, 238. For instance, the processes for splitting limed bovine hides may utilize 8.00 mm for the distance 236 and 6.00 mm for the distance 238. In addition, the processes for splitting blued bovine hides may utilize 9.00 mm for the distance 236 and 5.00 mm for the distance 238. In general, it is noted herein the closer the knife 220 edge is to the center of work area where maximum bovine hide compression occurs, the more accurate the split up to a select point, after which the accuracy of the split then begins to decrease. For example, a 10.00 mm distance 236 / 4.00 mm distance 238 or greater-ratio split may see reduced accuracy. Similarly, a 5.00 mm distance 236 / 9.00 mm distance 238 or smaller-ratio split may see reduced accuracy.

In another embodiment, the hide splitting machine 100 includes a height 240 between the one or more guide rolls 204 and the one or more ring rolls 208. For example, the height 240 may be any value within a range between 0.01 mm and 7.00 mm. For instance, the height 240 may be between 0.50 mm and 4.00 mm.

It is noted herein, however, the height 240 may vary during operation of the hide splitting machine 100 as the fresh bovine hide 106 passes through the hide splitting machine 100, due to variance in the fresh bovine hide 106 and the single or multi-level softness of the one or more rubber rolls 212. For example, the softness of the one or more rubber rolls 212 may allow the one or more rubber rolls 212 to elastically deform in response to a force provided by the fresh bovine hide 106 transferred to the one or more rubber rolls 212 via the one or more ring rolls 208, such that the one or more ring rolls 208 are allowed to move up and/or down relative to the one or more knife jaws 216 along the length of the fresh bovine hide 106 to counteract the force provided by the fresh bovine hide 106.

In another embodiment, the height 240 is definable relative to the edge of the knife 220, being separable into a splitting thickness 242 and a collagen thickness 244. For example, the splitting thickness 242 may generate the top grain 108 and the collagen sheet 110, where the top grain 108 is measured as the thickness of the fresh bovine hide 106 excluding hair from the epidermis into the corium.

For example, the splitting thickness 242 may be any value within a range between 0.01 mm and 7.00 mm. For instance, the splitting thickness 242 may be any value within a range between 0.50 mm and 5.50 mm to generate a top grain 108 of between 0.50 and 5.50 mm in thickness. Further, the splitting thickness 242 may be at least 0.80 mm to generate a top grain 108 of at least 0.80 mm in thickness by separating the grain, the grain and corium junction, and the portion of the corium (e.g., the top epidural layer) from the remainder of the corium (the hair not being included into the thickness of the top grain 108), where the focus is on manufacturing the collagen sheet 110 for downstream consumer products. In addition, the splitting thickness 242 may be any value within a range of 1.10 mm and 1.30 mm to generate a top grain 108 of between 1.10 and 1.30 mm (the hair not being included into the thickness of the top grain 108), where the focus is on leather uses of the top grain 108 in select leather industries (e.g., automotive, or the like). It is noted herein that limed or blued bovine hides are traditionally split at between 1.10 mm and 1.30 mm, due to a focus on leather uses of the top grain 108 in select leather industries, and that splitting the top grain 108 at 0.8 mm is traditionally considered too thin for leather uses.

By way of another example, the collagen thickness 244 may be any value within a range between 0.00 mm and 6.99 mm. For instance, the collagen thickness 244 may be any value within a range between 0.00 mm (e.g., flush or substantially flush) and 1.00 mm. Further, the collagen thickness 244 may be 0.01 mm.

In general, the splitting thickness 242 may be adjusted to account for variances in physical parameters of the animal from which the fresh bovine hide 106 is generated. For example, the physical parameters may include, but are not limited to, bovine hide thickness, hair texture, and/or hair length for a particular bovine breed, bovine sex, bovine age, and the like. The splitting thickness 242 may be defined as a distance between an edge of the one or more knives 220 edge and the bottom point of the one or more gauge rolls 204. For example, the splitting thickness 242 may be set so that the gauge roll 204 may absorb differences in friction caused by the variances in hair texture and/or hair length. By way of another example, the splitting thickness 242 may be increased for bovine hides with longer hair. It is noted herein the knife assembly 214 may be positioned closer to the ring roll 208 than the gauge roll 204 to ensure a consistency of cut, contributing to the differences between the splitting thickness 242 and the collagen thickness 244.

In another embodiment, the one or more knives 220 may be a select thickness. For example, the thickness of the one or more knives 220 may be any value within a range between 0.05 mm and 5.50 mm. For instance, the thickness of the one or more knives 220 may be 1.20 mm. In another embodiment, the one or more knives 220 may be a select total length and operate at a select speed. For example, the one or more knives 220 may be 5.20 m in length and may rotate at a speed of 280 rpm. It is noted herein the gap 218 may be a distance between the one or more knife jaws 216 configured to accept the one or more knives 220.

In another embodiment, the one or more knife jaws 216 may include the same or different beveled edges, and/or same or different bevel angles. For example, the one or more knife jaws 216 may include an upper beveled edge 246 with an upper beveled angle and/or a lower beveled edge 248 with a lower beveled angle, with the beveled edges 246, 248 each being any value within a range between 1.00 mm (e.g., flush or substantially flush) and 7.00 mm. For instance, the upper beveled edge 246 may be 5.00 mm and the upper beveled angle may be at or approximately at eight degrees. In addition, the lower beveled edge 248 may be 4.50 mm and the lower beveled angle may be at or approximately at nine degrees. It is noted herein the differences in the beveled edges 246, 248 may be necessary to correct direct the top grain 108 and the collagen sheet 110 into respective exits 112, 116.

In another embodiment, the one or more ring rolls 208 may include a select diameter 250. For example, the diameter 250 may be any value within a range between 45.00 mm and 85.00 mm. For instance, the diameter 250 may preferably be 50.00 mm or 55.00 mm.

In another embodiment, a top edge of the one or more ring jaws 210 may be separated from a top edge of the one or more ring rolls 208 closest to the at least one gauge roll 204 (e.g., the edge in the working area) a select distance 252. For example, the distance may be any value within a range between 25.50 mm and 27.50 mm, or slightly below the center axis of the one or more ring jaws 210 to allow for fall-away of the collagen sheet 110. For instance, the distance 252 may be 26.50 mm. Further, the distance 252 may be 27.00 mm.

In another embodiment, the ring roll 208 is smooth. It is noted herein the distance 252 being 26.50 mm or 27.00 mm is non-typical, as the standard for a notched roll used with limed or blued bovine hides is 26.00 mm. In addition, it is noted herein the ring roll 208 may be notched instead of being smooth.

In another embodiment, the hide splitting machine 100 includes a tolerance gap 254 between the feed shelf 102 and the one or more ring rolls 208. For example, the tolerance gap 254 may be any value within a range between 0.00 mm and 0.50 mm. For instance, the tolerance gap 254 may be 0.20 mm.

In another embodiment, the hide splitting machine 100 includes a tolerance gap 256 between the one or more ring jaws 210 and the one or more ring rolls 208. For example, the tolerance gap 256 may be any value within a range between 0.00 mm and 0.50 mm. For instance, the tolerance gap 256 may be 0.00 mm, or flush or substantially flush against the one or more ring rolls 208. It is noted herein the tolerance gap 256 may need to be flush or substantially flush to prevent portions from the collagen sheet 110 from entering the internal portions of the hide splitting machine 100 outside of the work area.

In another embodiment, the one or more rubber rolls 212 include a total diameter 258. For example, the total diameter 258 may be any value within a range between 150.00 mm and 255.50 mm. For instance, the total diameter 258 may be 200.00 mm.

In another embodiment, the total diameter 258 is separable into diameters for each of the various cores, where the one or more rubber rolls 212 are fabricated from multiple cores. For example, a layer 212*a* and/or a layer 212*b* may each include a diameter of any value within a range between 5.00 mm and 50.00 mm. For instance, the layer 212*a* may be a diameter 260 of 20.00 mm and the layer 212*b* may be a diameter 262 of 35.00 mm. By way of another example, the metal inner core 212*c* may be a diameter of any value within a range between 50.00 mm and 240.00 mm. For instance, the metal inner core 212*c* may be a diameter 264 of 145.00 mm.

It is noted herein, however, the total diameter 258 may vary during operation of the hide splitting machine 100 as the fresh bovine hide 106 passes through the hide splitting machine 100, due to variance in the fresh bovine hide 106 and the single or multi-level softness of the one or more rubber rolls 212. For example, the softness of the one or more rubber rolls 212 may allow the one or more rubber rolls 212 to elastically deform in response to a force provided by the fresh bovine hide 106 transferred to the one or more rubber rolls 212 via the one or more ring rolls 208, such that the one or more ring rolls 208 are allowed to move up and/or down relative to the one or more knife jaws 216 along the length of the fresh bovine hide 106 to counteract the force provided by the fresh bovine hide 106.

In this regard, the splitting of the fresh bovine hide 106 includes a particular setup of the hide splitting machine 100 to ensure a proper split occurs, that particular setup including, but is not limited to a position of the blade and knife jaws, type of gauge roll and/or ring roll. This results in an improvement over previous hide splitting methods, as the hide splitting machine 100 settings are those that were previously not thought possible or feasible. It is noted herein the fine-tuning of the components of the hide splitting machine 100, being on the order of tenths or hundredths of millimeters, results in any measurable change to the operating parameters being a non-typical and/or potentially non-obvious change. In light of known, long-standing operating procedures for splitting limed or blued bovine hides, the parameters for the fresh bovine hide 106 as described throughout should be considered a non-obvious change that would not be determined without experimentation.

Figure 3A:
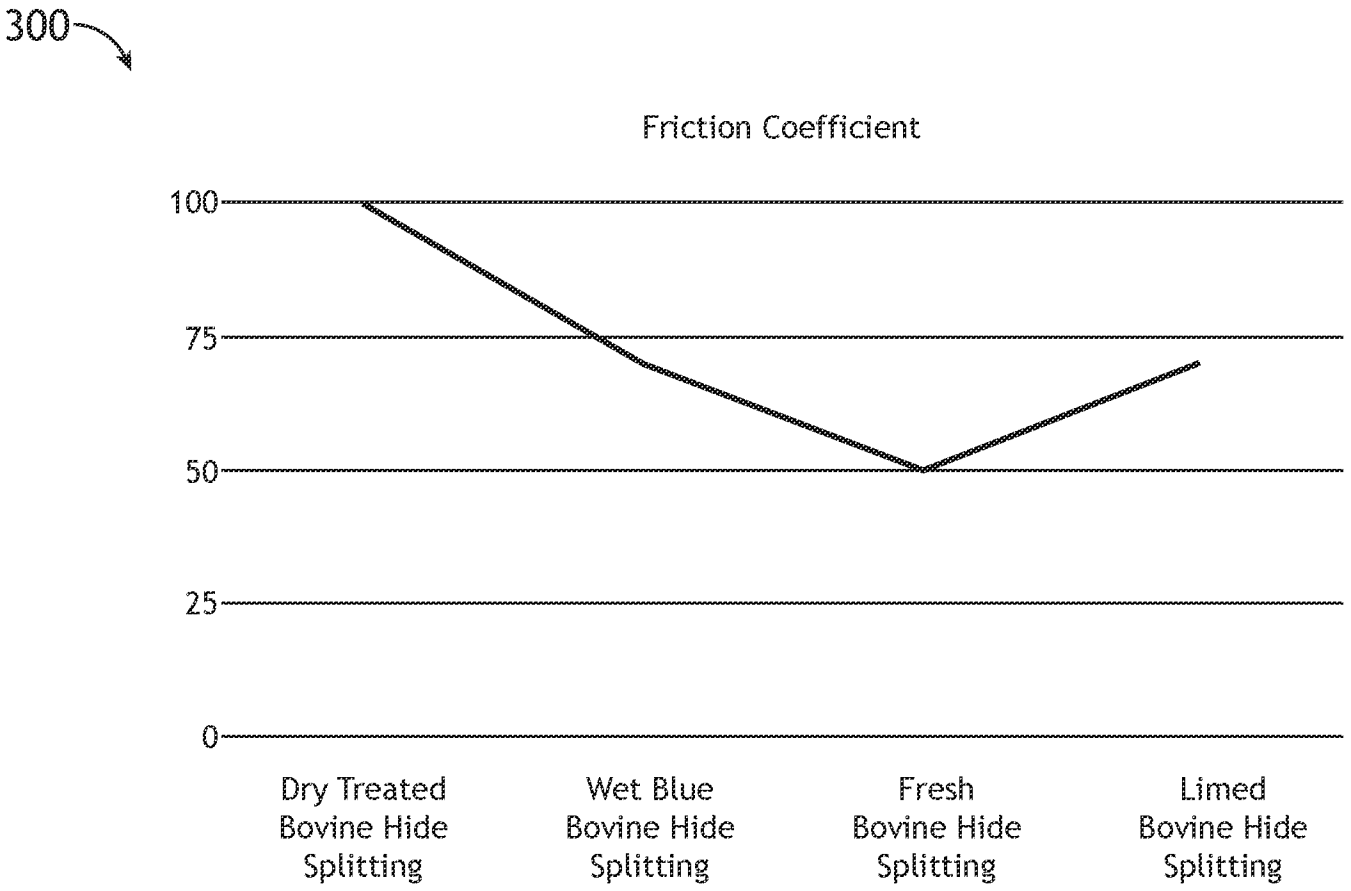
FIG. 3A is a bar graph comparing friction coefficient for different types of bovine hides, in accordance with one or more embodiments of the present disclosure.
Figure 3B:
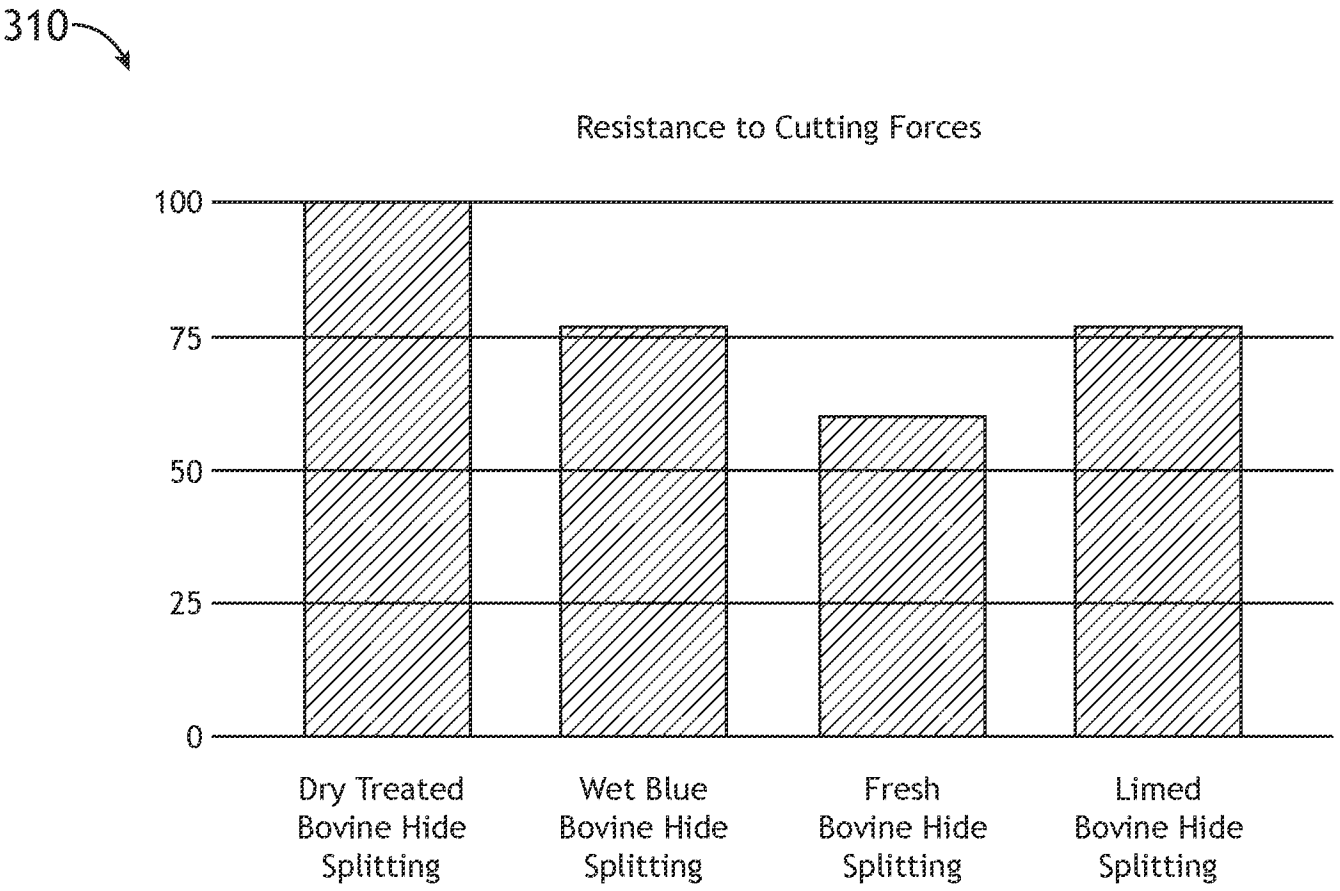
FIG. 3B is a bar graph comparing resistance to cutting forces for different types of bovine hides, in accordance with one or more embodiments of the present disclosure.
Figure 3C:
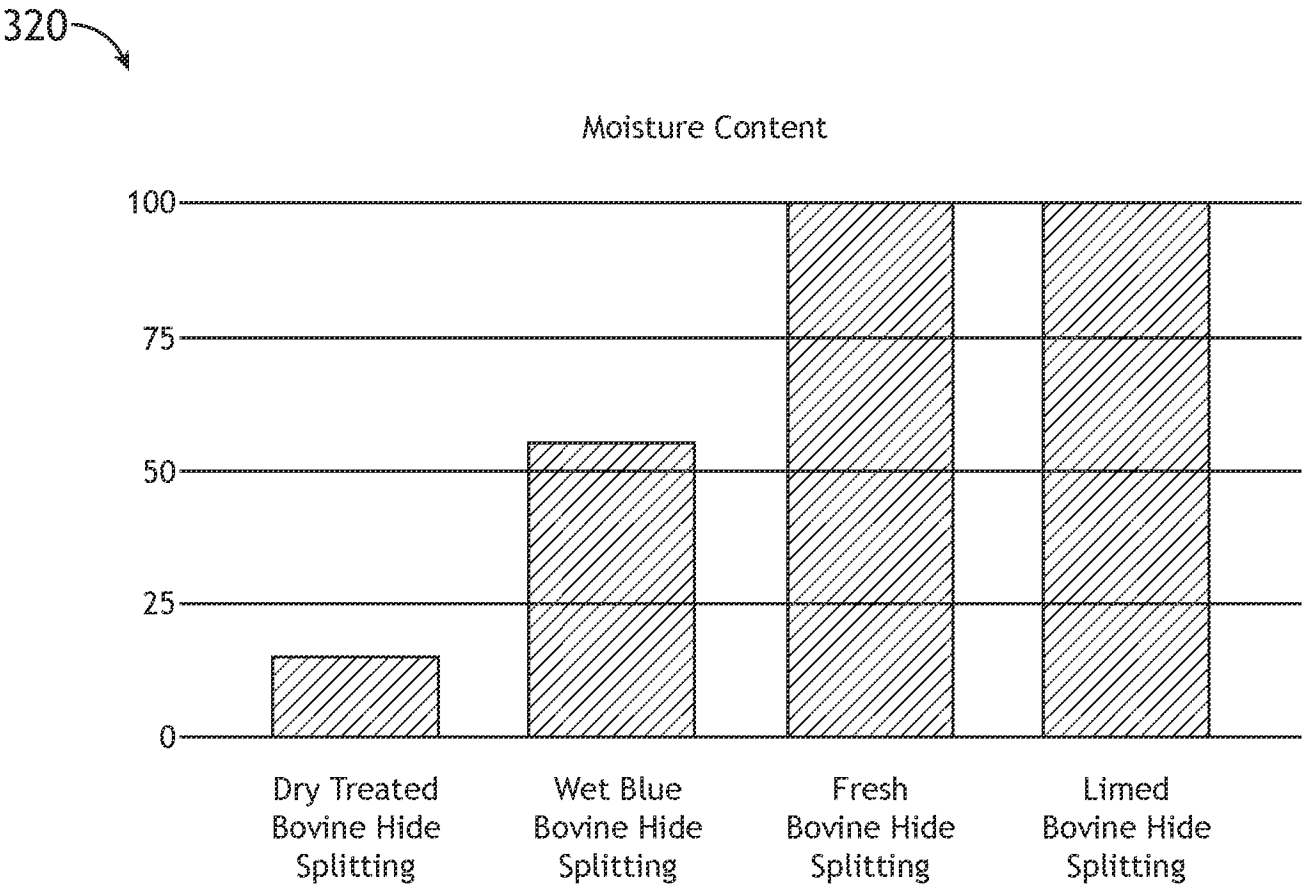
FIG. 3C is a bar graph comparing moisture content for different types of bovine hides, in accordance with one or more embodiments of the present disclosure.

FIGS. 3A-3C in general illustrate comparisons between dry treated splitting, wet blue splitting, fresh bovine hide splitting, and lime splitting, in accordance with one or more embodiments of the present disclosure.

In FIG. 3A, a graph 300 illustrates a comparison of friction coefficient between dry treated splitting, wet blue splitting, fresh bovine hide splitting, and lime splitting. As illustrated in FIG. 3A, fresh bovine hide splitting performed in a wet environment (e.g., one where water or another fluid considered safe for downstream products is applied to the fresh bovine hide as it passes through the hide splitting machine 100) results in a lower friction coefficient than dry treated splitting, wet blue splitting, and lime splitting. This lower friction coefficient may result in less wear to components of the hide splitting machine 100 than may be caused during dry treated splitting, wet blue splitting, and lime splitting.

In FIG. 3B, a graph 310 illustrates a comparison of resistance to cutting forces between dry treated splitting, wet blue splitting, fresh bovine hide splitting, and lime splitting. As illustrated in FIG. 3B, fresh bovine hide with hair has a lower resistance to cutting forces than dry treated splitting, wet blue splitting, and lime splitting. This lower resistance to cutting forces may result in a more consistent split between the top grain 108 and the collagen sheet 110 than may be observed with dry treated splitting, wet blue splitting, and lime splitting.

In FIG. 3C, a graph 320 illustrates a comparison of moisture content between dry treated splitting, wet blue splitting, fresh bovine hide splitting, and lime splitting. As illustrated in FIG. 3C, fresh bovine hide with hair have a similar moisture content as lime split bovine hides and a greater moisture content than dry treated split bovine hides and wet blue bovine hides. This moisture content may result in a more quality product for the top grain 108 and the collagen sheet 110 than may be observed with dry treated split bovine hides and wet blue bovine hides.

It is noted herein the fresh bovine hide may have or retain a neutral pH (e.g., a pH between 6 and 8, for purposes of the present disclosure) absent any unnatural or chemical interventions. For example, for the downstream gelatin users of the fresh splits, the bovine hides will be received completely chemical/salt free and a reduction in costs of further extracting sulfides out of the product will be experienced. In this regard, this is an improvement over a limed bovine hide that has been exposed to calcium hydroxide, sodium hydroxide, or the like and would be highly basic in nature with a considerable range of pH levels (e.g., a pH between 10 and 13). This requires the limed bovine hides to be washed and/or neutralized prior to delivery of the splits/trims to the downstream manufacturers (e.g., gelatin companies, or the like), the run-off of which may end up in the environment. In addition, splits of the limed bovine hides may retain some basic nature and/or some permanent alteration, as caused by the liming process, which may adversely affect the downstream products.

In this regard, the impact of the fresh bovine hide with hair on the hide splitting machine 100 is similar to limed bovine hides with respect to the one or more knives 220 and grinding stones, with the one or more knives 220 and grinding stones needing to be changed between every 40,000 to 50,000 bovine hides. In contrast, the wet blued bovine hides may cause the one or more knives 220 and grinding stones to be changed every 20,000 to 25,000 bovine hides, and the dry treated bovine hides may cause the one or more knives 220 and grinding stones to be changed every 5,000 to 8,000 bovine hides. It is noted herein the hide splitting machine 100 may not require dust collectors when splitting fresh bovine hides with hair as grinding stones dust may dissolve in the water applied to the fresh bovine hides with hair during splitting.

In addition, the impact of the fresh bovine hide with hair on the hide splitting machine 100 is similar to limed bovine hides with respect to the one or more gauge rolls 204, the one or more rubber rolls 212, and one or more scrapers, with the one or more gauge rolls 204, the one or more rubber rolls 212, and the one or more scrapers needing to be changed between every 800,000 to 900,000 bovine hides. In contrast, the wet blued bovine hides may cause the one or more gauge rolls 204, the one or more rubber rolls 212, and the one or more scrapers to be changed every 400,000 to 500,000 bovine hides, and the dry treated bovine hides may cause the one or more gauge rolls 204, the one or more rubber rolls 212, and the one or more scrapers to be changed every 300,000 to 400,000 bovine hides.

Further, the impact of the fresh bovine hide with hair on the hide splitting machine 100 is similar to limed bovine hides, wet blued bovine hides, and dry treated bovine hides with respect to the one or more ring jaws 210, with the one or more ring jaws 210 needing to be changed between every 800,000 to 900,000 bovine hides.

In this regard, the wet bovine hides 106 may cause a lesser amount of wear and tear on the hide splitting machine 100 than the limed bovine hide, the blued bovine hide, and/or the dry treated bovine hide.

Figure 4:
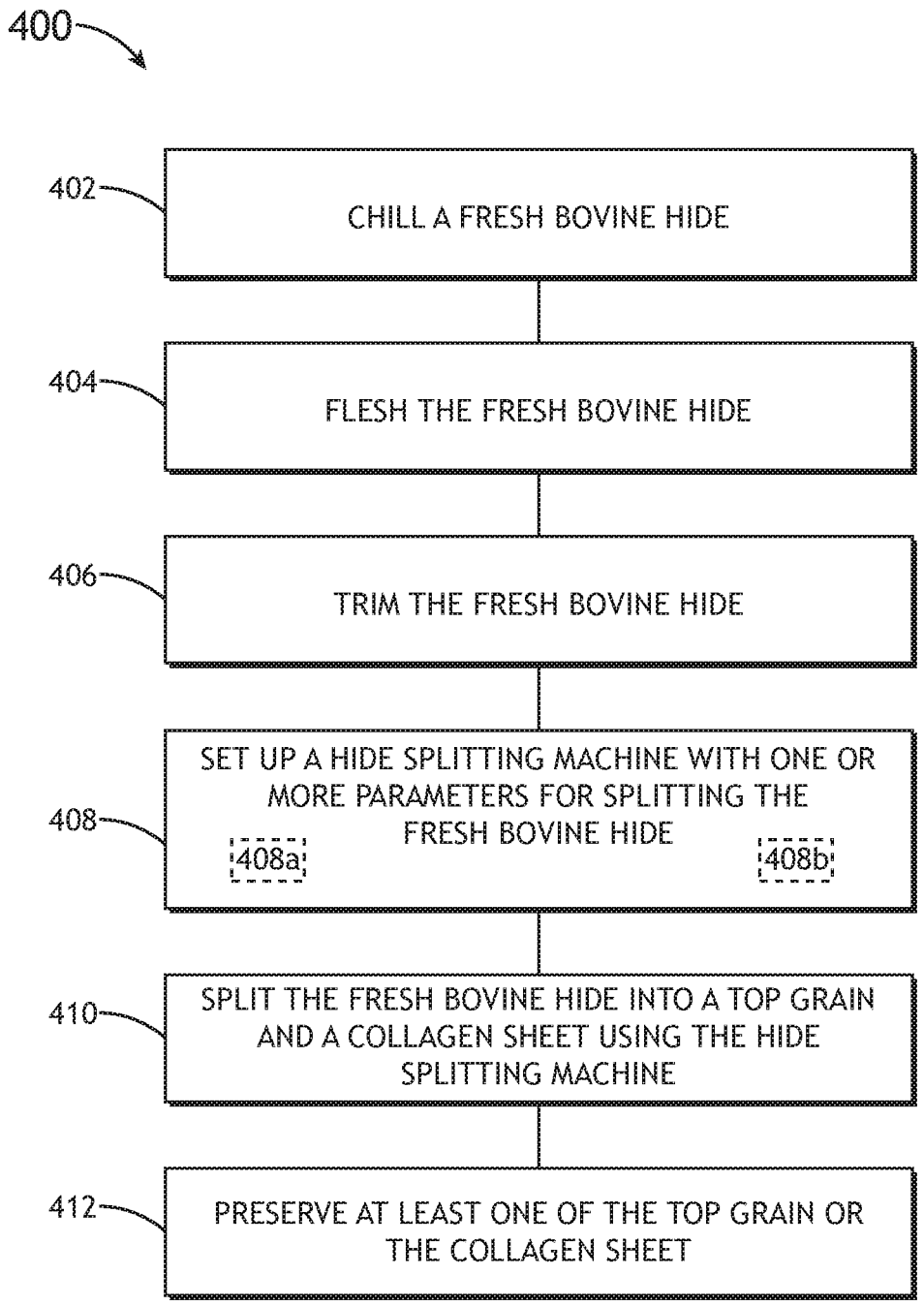
FIG. 4 is a method for fresh bovine hide splitting, in accordance with one or more embodiments of the present disclosure.

FIG. 4 illustrates a method or process 400 for fresh bovine hide splitting, in accordance with one or more embodiments of the present disclosure. It is noted herein that the steps of method or process 400 may be implemented all or in part by the hide splitting machine 100. It is further recognized, however, that the method or process 400 is not limited to the hide splitting machine 100 in that additional or alternative system-level embodiments may carry out all or part of the steps of method or process 400.

In a step 402, a fresh bovine hide is chilled. In one embodiment, the fresh bovine hide is chilled to provide a select level of rigidity. For example, the fresh bovine hide may be chilled to between 10 and 12.8 degrees Celsius (° C.), (or between 50 and 55 degrees Fahrenheit (° F.)). It is noted herein the fresh bovine hide would not have the rigidity of a limed or blued bovine hide, being sloppy and non-rigid from the initial processing steps, resulting in the possible need for chilling. In addition, it is noted herein the fresh bovine hide would not have a level of preservatives of a limed or blued bovine hide, resulting in the possible need for chilling to delay rot or decay. It is noted herein, the splitting of the fresh bovine hide 106 includes a need for the fresh bovine hide 106 to be chilled (e.g., to provide enough rigidity to allow the hide splitting machine 100 to correctly split the fresh bovine hide 106).

In a step 404, a fresh bovine hide is fleshed. In one embodiment, the fresh bovine hide is fleshed to remove remaining deposits of fat, muscle, blood, or the like. For example, the fresh bovine hide may be put through a fleshing machine once or multiple times. The fresh bovine hide may be washed prior to, during, or after the fleshing.

In a step 406, the fresh bovine hide is trimmed. For example, the fresh bovine hide may be trimmed for purposes of fitting within a hide splitting machine 100. By way of another example, the fresh bovine hide may be trimmed to maintain a select quality of fresh bovine hide for downstream products being made from the top grain 108 and/or the collagen sheet 110. By way of another example, the fresh bovine hide may be trimmed to remove rot or decay that has formed.

In a step 408, a hide splitting machine is set up with one or more parameters for splitting the fresh bovine hide. In one embodiment, in a step 408*a* components of the hide splitting machine 100 are tested and selected to determine at least the correct splitting thickness 242 and other parameters of the components of the hide splitting machine 100 (e.g., as illustrated in at least FIGS. 2A-2C) are determined, where the parameters are specific to splitting a fresh bovine hide as opposed to splitting a limed or blued bovine hide. In another embodiment, in a step 408*b* the hide splitting machine 100 is set up with the parameters specific to splitting a fresh bovine hide 106, as opposed to splitting a limed or blued bovine hide, including the installation of appropriate components in the hide splitting machine 100 as necessary to ensure at least the correct splitting thickness 242 and other parameters of the components of the hide splitting machine 100 (e.g., as illustrated in at least FIGS. 2A-2C).

In a step 410, the fresh bovine hide is split into a top grain and a collagen sheet using the hide splitting machine. In one embodiment, the fresh bovine hide 106 is fed into the feed opening 104 along the feed table 102 by one or more operators. For example, the one or more operators may use the feed table 102 and tools to flatten (e.g., smooth, unfold, or the like) the fresh bovine hide 106 prior to insertion into the feed opening 104 (and subsequently the work area within the hide splitting machine 100), while maintaining its flattened state along the length of the fresh bovine hide 106.

It is noted herein the top grain 108 that is split from the collagen sheet 110 using one or more steps of the method or process 400 may be usable by a number of downstream manufacturers. For example, where the top grain 108 is thick enough, the tanners may utilize the top grain 108 for further products, such that an entire fresh bovine hide 106 may not need to be treated with various bluing and/or liming stages. This may result in an increase of profits, as the various bluing and/or liming stages are traditionally completed at a cost/pound of bovine hide—by reducing the overall weight of the fresh bovine hide 106 prior to the depilation and/or fixing stages may reduce overall costs and/or environment impact from tanning chemicals, labor, and water treatment.

In a step 412, at least one of the top grain or the collagen sheet is preserved. For example, at least one of the top grain 108 or the collagen sheet 110 may be frozen or chilled. By way of another example, at least one of the top grain 108 or the collagen sheet 110 may be preserved with a salt or salt-based solution. It is noted herein, however, the salt will need to be extracted prior to use of the collagen sheet 110 in downstream products.

Figure 5:
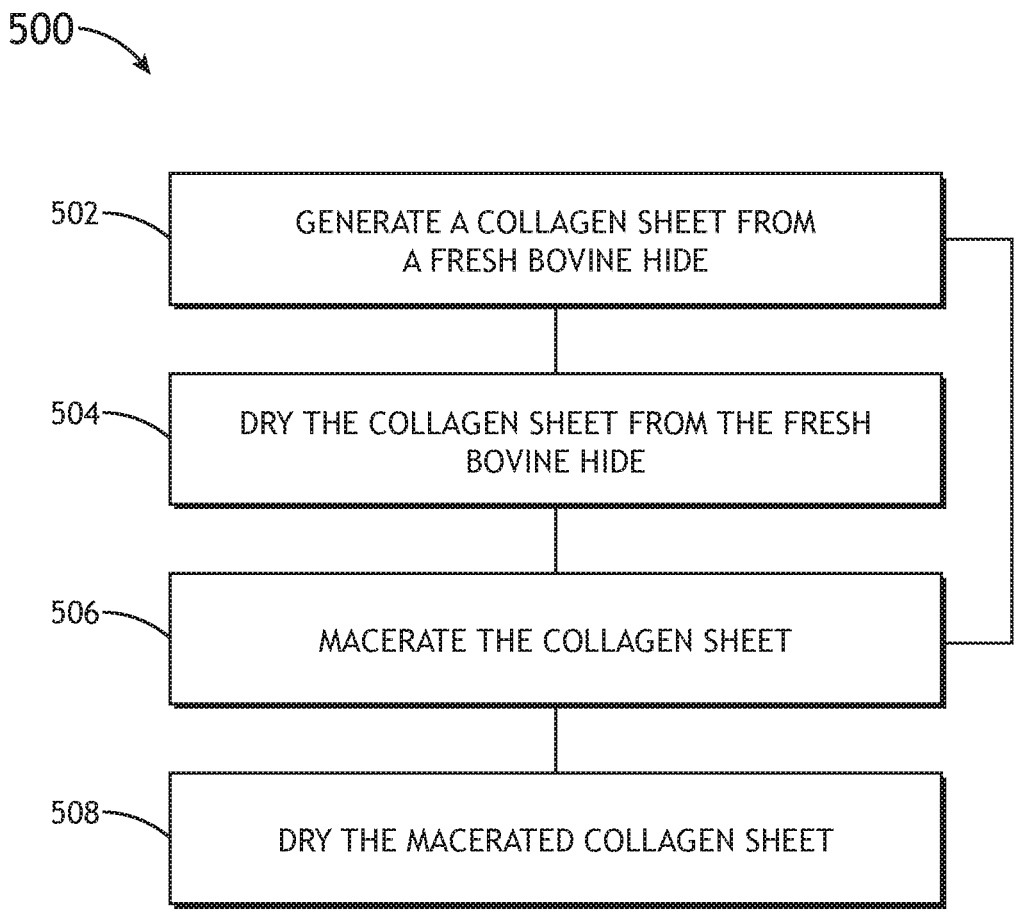
FIG. 5 is a method for fresh bovine hide splitting, in accordance with one or more embodiments of the present disclosure.

FIG. 5 illustrates a process 500 for processing a collagen sheet 110 split from a fresh bovine hide to generate a fresh bovine hide raw material product, in accordance with one or more embodiments of the present disclosure. It is noted herein that the steps of method or process 500 may be implemented all or in part by the hide splitting machine 100. It is further recognized, however, that the method or process 500 is not limited to the hide splitting machine 100 in that additional or alternative system-level embodiments may carry out all or part of the steps of method or process 500.

In a step 502, a collagen sheet is generated from a fresh bovine hide. In one embodiment, a collagen sheet 110 is split from a fresh bovine hide 106 using one or more steps of the method or process 400.

In a step 504, the collagen sheet from the fresh bovine hide is dried. In one embodiment, the collagen sheet 110 is dried at a select temperature for between six and sixteen hours. For example, the collagen sheet 110 may be dried at 71.1° C. (or 160° F.) for between twelve and fifteen hours. By way of another example, the collagen sheet 110 may be dried for an eight-hour dry cycle.

In a step 506, the collagen sheet is macerated. In one embodiment, the dried collagen sheet 110 is shredded or chipped. It is noted herein that macerating the dried collagen sheet 110 allows for a tighter packing of the collagen sheet 110 during transport to a downstream producer, potentially reducing shipping costs.

It is noted herein the method or process 500 may include steps 502, 504, and 506 during an instance where the collagen sheet is dried prior to being macerated. In addition, it is noted herein the method or process 500 may include steps 502 and 506 and not include step 504 during an instance where the collagen sheet is macerated prior to drying.

In a step 508, the macerated collagen sheet is dried. It is noted herein that macerating the collagen sheet 110 may see a reintroduction of moisture due to thermal friction. As such, a first drying step (e.g., in the instance where the drying step 504 is not performed before the macerating step 506) or a second drying step (e.g., in the instance where the drying step 504 is performed before the macerating step 506) may be desired to fully preserve the macerated collagen sheet 110.

It is noted herein the macerated collagen sheet forms a fresh bovine hide raw material product, either with or without the second drying of step 508.

In another embodiment, the dried and macerated collagen sheet 110 meets select collagen qualifications, including a water activity below 0.7. For example, the dried collagen sheet 110 may have a water activity below 0.5. For instance, the dried collagen sheet 110 may have a water activity of 0.25-0.26. It is noted herein the water activity of limed or blued bovine hides is higher, not being dried. It is noted herein water activity is has a unit of w, which represents a ratio between the vapor pressure of the food itself when in a completely undisturbed balance with the surrounding air media, and the vapor pressure of distilled water under identical conditions.

It is noted herein steps 504, 506, 508 are designed to preserve the collagen sheet 110 without the use of salt, to be provided for downstream products in a usable form. In this regard, the drying of the fresh bovine hide 106 may result in a removal of moisture and/or a stabilization of the collagen sheet 110 in order to preserve for future use. This results in an improvement over existing bovine hide by-product techniques, as it was previously not thought possible or feasible to preserve a raw natural product to have a long-term shelf life without the use of chemical additives, salts, or the like.

It is noted herein the methods or processes 400 and 500 are not limited to the steps and/or sub-steps provided. In one non-limiting example, at least one of the steps 402, 404, 406, 408 may be previously performed, such that they need not be performed in the method or process 400 or may not be performed in a same relative timeframe as the remaining steps of the method or process 400. In another non-limiting example, the step 508 may not be required where moisture has not been re-introduced. The methods or processes 400 and 500 may include more or fewer steps and/or sub-steps. The methods or processes 400 and 500 may perform the steps and/or sub-steps simultaneously. The methods or processes 400 and 500 may perform the steps and/or sub-steps sequentially, including in the order provided or an order other than provided. In one non-limiting example, the step 408 may be performed before steps 402, 404, and 406. In another non-limiting example, the step 404 may be performed before step 402. Therefore, the above description should not be interpreted as a limitation on the scope of the present disclosure but merely an illustration.

It is further contemplated that each of the embodiments of the methods or processes 400 and 500 described above may include any other step(s) of any other method(s) described herein. In addition, each of the embodiments of the methods or processes 400 and 500 described above may be performed by any of the systems described herein.

Figure 6:
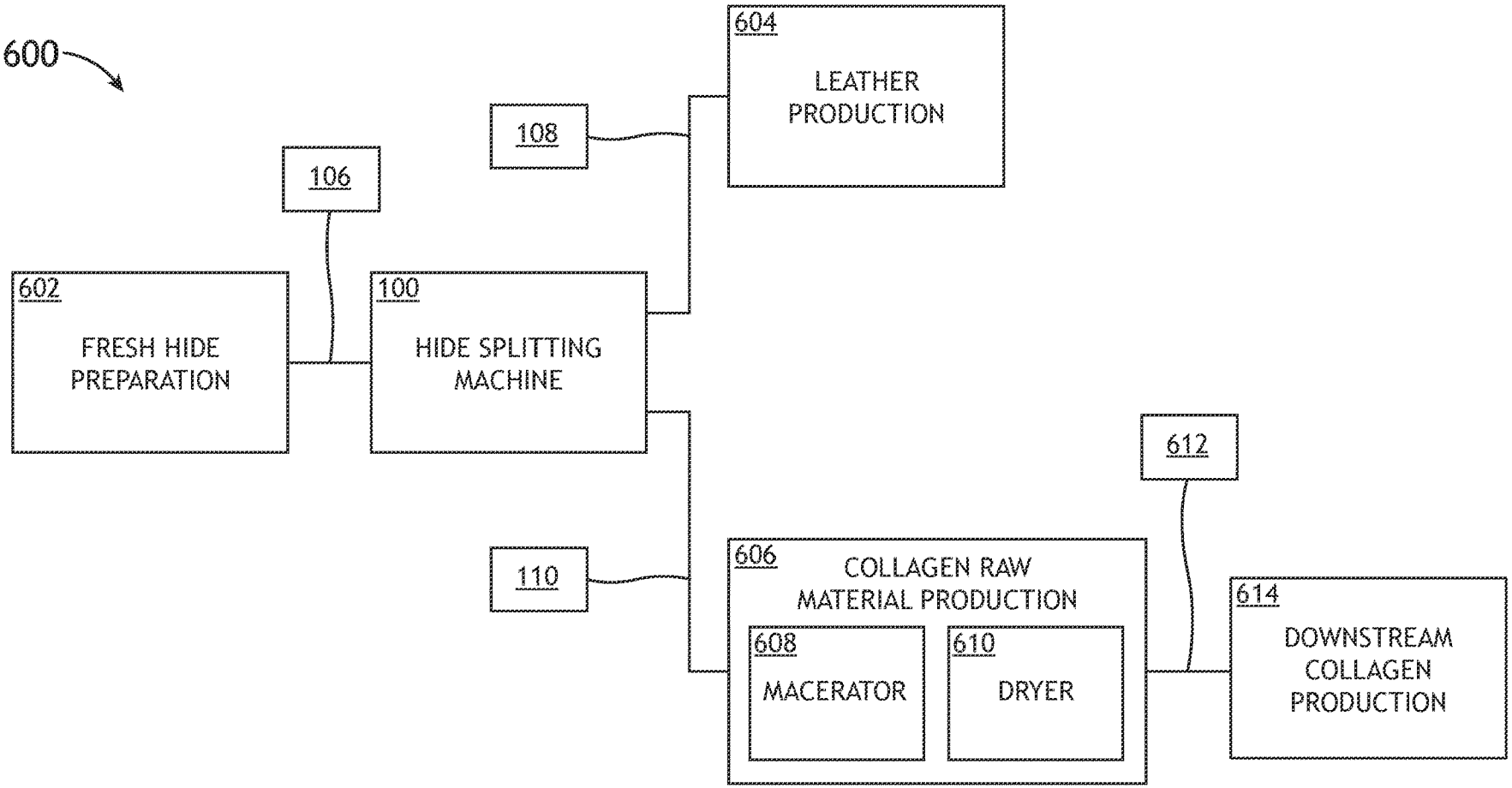
FIG. 6 is a simplified block diagram of a system for fresh bovine hide splitting, in accordance with one or more embodiments of the present disclosure.

FIG. 6 illustrates a system 600 for fresh bovine hide splitting, in accordance with one or more embodiments of the present disclosure. It is noted herein the system 600 may be configured to perform any steps of the methods or processes 400 and 500, and/or any steps of the methods or processes 400 and 500 may be directed to components of the system 600.

In one embodiment, the system 600 includes one or more machines and/or processing tools 602 for preparation of the fresh bovine hide. For example, the one or more apparatuses or processing tools 602 may include, but are not limited to, pre-slaughtering handling machines and/or processing tools, stunning machines and/or processing tools, slaughtering machines and/or processing tools, exsanguination machines and/or processing tools, de-pelting or de-hiding machines and/or processing tools, fleshing machines and/or processing tools, chilling machines and/or processing tools, trimming machines and/or processing tools, or the like. In another embodiment, the one or more machines and/or processing tools 602 are used to produce the fresh bovine hide 106.

In another embodiment, the system 600 includes the hide splitting machine 100, as described throughout the present disclosure. In another embodiment, the fresh bovine hide 106 is transferred from the one or more machines and/or processing tools 602 to the hide splitting machine 100. In another embodiment, the fresh bovine hide 106 is split into the top grain 108 and the collagen sheet 110 with the hide splitting machine 100.

In another embodiment, the system 600 includes one or more machines and/or processing tools 604 for leather production. For example, the one or more machines and/or processing tools 604 may include, but are not limited to, leathery tannery machines and/or processing tools, or the like. For instance, the one or more machines and/or processing tools 604 may be usable for processes including, but not limited to, beam house operations or beaming processes (e.g., processes used in the production of leather between curing and tanning processes such as, but not limited to, soaking, liming, removal of extraneous tissues (e.g., unhairing, scudding, and/or fleshing), deliming, bating or puering, drenching, pickling, or the Ike).

In another embodiment, the top grain 108 is transferred from the hide splitting machine 100 to the one or more machines and/or processing tools 604. It is noted herein the top grain 108 may be considered a fresh bovine hide product produced from the fresh bovine hide 106, upon which various methods and processes are employed when the top grain 108 is prepared for use in the leather industry.

In another embodiment, the system 600 includes one or more collagen raw material production machines and/or processing tools 606. For example, the one or more collagen raw material production machines and/or processing tools 606 may include but are not limited to, one or more macerators 608 (e.g., cutters, chippers, shredders, or the like), one or more dryers 610, or the like. In another embodiment, the collagen sheet 110 is transferred from the hide splitting machine 100 to the one or more collagen raw material production machines and/or processing tools 606. In another embodiment, the one or more collagen raw material production machines and/or processing tools 606 are used to produce a fresh bovine hide raw material product 612.

In another embodiment, the system 600 includes one or more downstream collagen production machines and/or processing tools 614. For example, the one or more downstream collagen production machines and/or processing tools 614 may include, but are not limited to, one or more machines and/or processing tools used for manufacturing foods suitable for human consumption (e.g., gelatin, or the like), one or more machines and/or processing tools used for manufacturing foods suitable for animal consumption (e.g., animal feed, pet food, or the like), or the like. In another embodiment, the fresh bovine hide raw material product 612 is transferred from the one or more collagen raw material production machines and/or processing tools 606 to the one or more downstream collagen production machines and/or processing tools 614.

It is noted herein the machines and/or processing tools of the system 600 may be housed in a single facility, housed within multiple facilities on a single campus, housed within one or more facilities on multiple campuses owned by a single entity, or housed within separate facilities on multiple campuses owned by separate entities.

As should be understood from the systems and methods described throughout the present disclosure, processing a fresh bovine hide 106 instead of a limed or blued bovine hide has a number of benefits.

Processing the fresh bovine hide 106 may allow for an increased number of flexible uses of a commodity product for all downstream product types, including those manufactured from the top grain 108 and/or manufactured from the collagen sheet 110.

A fresh bovine hide split may possess all features and/or natures of naturally-occurring elastin existing in a fresh bovine hide 106, as the elastin is not removed until a bating process of a tanning process.

The fresh bovine hide 106 may retain naturally-present tightly-bound collagen fibers pre-split, as preservative processes such as unhairing-liming processes that would separate the collagen fibers are not introduced to the fresh bovine hides 106 if split with the setup as illustrated in FIGS. 2A-2C and described throughout the present disclosure, and the method or process 400 as illustrated in FIG. 4 and described throughout the present disclosure.

The use of the fresh bovine hide 106 instead of a limed or blued bovine hide may require a quicker timetable from initial splitting into the top grain 108 and the collagen sheet 110 to downstream production (e.g., on the order of hours) due to the lack of chemical preservatives (e.g., sulfides, or the like) provided by the liming or bluing processes. For instance, the quicker timetable may prevent the use of a middleman in the transfer of the collagen sheet 110 from the tanner to the downstream producer, such as a facility for producing goods for human consumption (e.g., a gelatin manufacturer, or the like). In this regard, cost savings may be afforded to the downstream manufacturer and/or the consumer.

In one non-limiting example, in the case of gelatin or other downstream consumer food product, it is noted herein a gelatin manufacturer would not need to treat a slurry generated from the collagen sheet 110 split from the fresh bovine hide 106 prior to the extraction of the gelatin from the slurry. In contrast, the gelatin manufacturer would likely need to treat the slurry formed from a collagen sheet obtained from a limed bovine hide (e.g., which would include preservative hydroxide salts and/or sulfides) with de-liming processes including, but not limited to, washing, acidification, or the like to remove and neutralize excess lime and sulfides and adjust the pH of the slurry prior to the extraction of the gelatin from the slurry.

In another embodiment, the collagen sheet 110 and/or any downstream raw material products (e.g., dried collagen sheet 110, macerated collagen sheet 110, dried and macerated collagen sheet 110, pre-gelatin slurry, or the like) would include less than one percent (1%) naturally-occurring sulfur by total weight. For example, the collagen sheet 110 and/or any downstream raw material products may include less than one percent (1%) naturally-occurring sulfur by total dried weight (e.g., approximately 1 milligram (mg)/3333 mg) or less than 0.33% total wet weight, with no additional sulfur introduced into the collagen sheet 110 and/or any downstream raw material product by preservative processes such as liming and/or beaming (e.g., processes used in the production of leather between curing and tanning processes).

In another embodiment, the collagen sheet 110 and/or any downstream raw material products (e.g., dried collagen sheet 110, macerated collagen sheet 110, dried and macerated collagen sheet 110, pre-gelatin slurry, or the like) would include less than one percent (1%) naturally-occurring calcium by total weight. For example, the collagen sheet 110 and/or any downstream raw material products may include less than one percent (1%) naturally-occurring calcium by total dried weight (e.g., approximately 16 mg/3333 mg) or less than 0.33% total wet weight, with no additional calcium introduced into the collagen sheet 110 and/or any downstream raw material product by preservative processes such as liming and/or beaming (e.g., processes used in the production of leather between curing and tanning processes). In contrast, wet limed hides may include between 1 and 2 percent calcium residue in the collagen (e.g., as deemed acceptable by standards in the gelatin industry) post-deliming, whether delimed prior to arrival at the gelatin manufacturer or delimed after arrival by the gelatin manufacturer.

In another embodiment, the collagen sheet 110 and/or any of its downstream raw material products (e.g., dried collagen sheet 110, macerated collagen sheet 110, dried and macerated collagen sheet 110, pre-gelatin slurry, or the like) would include non-measurable naturally-occurring trace amounts of sodium by total dried weight (and similarly by total wet weight), with no additional sodium introduced into the collagen sheet 110 and/or any downstream raw material product by preservative processes such as liming.

It is noted herein the collagen sheet 110 and/or any of its downstream raw material products (e.g., dried collagen sheet 110, macerated collagen sheet 110, dried and macerated collagen sheet 110, pre-gelatin slurry, or the like) may include select proteins with an average yield of 53.5±2.9% by total dry weight, and/or may include minerals (e.g., in element or compound form) in the appreciable total dry weight concentrations in mg/grams (g) (e.g., with total wet weight concentrations going down by a factor of −3x), as provided in Table 1:

TABLE 1

| Minerals | Dry concentration (mg/mg) | Wet concentration (mg/mg) |
|---|---|---|
| Iron (Fe) | 50/100000 | 50/300000 |
| Silicon (Si) | 19/100000 | 19/300000 |
| Antimony (Sb) | 18/100000 | 18/300000 |
| Calcium (Ca) | 16/100000 | 16/300000 |
| Tin (Sn) | 13/100000 | 13/300000 |
| Chromium (Cr) | 11/100000 | 11/300000 |
| Nickel (Ni) | 10/100000 | 10/300000 |
| Potassium (K) | 10/100000 | 10/300000 |
| Phosphorus (P) | 5/100000 | 5/300000 |
| Titanium (Ti) | 3/100000 | 3/300000 |
| Sulfur (S) | 1/100000 | 1/300000 |
| Copper (Cu) | 1/100000 | 1/300000 |
| Zinc (Zn) | 0.7/100000 | 0.7/300000 |
| Other elements | 0.7/100000 | 0.7/300000 |

In another embodiment, the collagen sheet 110 and/or any of its downstream raw material products (e.g., dried collagen sheet 110, macerated collagen sheet 110, dried and macerated collagen sheet 110, pre-gelatin slurry, or the like) would include no residue introduced into the collagen sheet 110 and/or any downstream raw material product by preservative processes such as liming.

Processing of the fresh bovine hide 106 and subsequent use in a downstream product may be more environmentally friendly, reducing environmental impact in both the tanning of further products or the manufacture of goods for human consumption (e.g., gelatin, or the like). For example, processing the fresh bovine hide 106 would require less chemical treating than if the bovine hide were limed.

Processing of the fresh bovine hide 106 may have an impact on markets. For example, the processing of the fresh bovine hide 106 may level out cyclical market swings where the sales of leather products fabricated from the top grain 108 pull against tannery demand, which results in additional collagen sheets 110 being produced that may be sold directly and/or being managed in a preserved form with a longer shelf-life usefulness of the product, following the preservation processes as described at least with respect to the method or process 500 illustrated in FIG. 5 and described throughout the present disclosure.

As such, advantages of the present disclosure include a system and method for fresh bovine hide splitting. Specifically, advantages of the present disclosure are directed to system parameters for the hide splitting machine 100 to allow for the working of fresh bovine hides 106 in place of limed or blued bovine hides. Advantages of the present disclosure also are directed to methods of preparing the fresh bovine hide 106 prior to separation, inserting the fresh bovine hide 106 into the hide splitting machine 100, and removal of the top grain 108 and the collagen sheet 110 from the hide splitting machine 100 after separation. Advantages of the present disclosure are also directed to downstream products produced from the top grain 108 and/or the collagen sheet 110. Advantages of the present disclosure are also directed to reduced cost and/or environmental impact by splitting the fresh bovine hides 106 instead of limed or blued bovine hides, and further drying those hides for preservation and further use.

Although embodiments of the present disclosure are directed to fresh bovine hides and system components such as hide splitting machines 100 for splitting fresh bovine hides, it is noted herein the embodiments as described throughout the present disclosure may be understood as being applicable to other types of animal hides and/or other types of system components, for purposes of the present disclosure. For example, the embodiments as described throughout the present disclosure may be applied to any type of animal hide known in the art such that "fresh bovine hide", "fresh bovine hide raw material product", or the like should not be considered limiting.

One skilled in the art will recognize that the herein described components operations, devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components, operations, devices, and objects should not be taken as limiting.

As used herein, directional terms such as "top," "bottom," "over," "under," "upper," "upward," "lower," "down," and "downward" are intended to provide relative positions for purposes of description, and are not intended to designate an absolute frame of reference. Various modifications to the described embodiments will be apparent to those with skill in the art, and the general principles defined herein may be applied to other embodiments With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

The herein described subject matter sometimes illustrates different components contained within, or connected with, other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected," or "coupled," to each other to achieve the desired functionality, and any two components capable of being so associated can also be viewed as being "couplable," to each other to achieve the desired functionality. Specific examples of couplable include but are not limited to physically mateable and/or physically interacting components and/or wirelessly interactable and/or wirelessly interacting components and/or logically interacting and/or logically interactable components.

Furthermore, it is to be understood that the invention is defined by the appended claims. It will be understood by those within the art that, in general, terms used herein, and especially in the appended claims (e.g., bodies of the appended claims) are in general intended as "open" terms (e.g., the term "including" should be interpreted as "including but not limited to," the term "having" should be interpreted as "having at least," the term "includes" should be interpreted as "includes but is not limited to," and the like). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, and the like" is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, and the like). In those instances where a convention analogous to "at least one of A, B, or C, and the like" is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, and the like). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B".

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Furthermore, it is to be understood that the invention is defined by the appended claims.

What is claimed:

1. A fresh bovine hide raw material product, wherein the fresh bovine hide raw material product has a water activity less than 0.7 w and a calcium residue of less than 0.33% by total wet weight, wherein the fresh bovine hide raw material product is produced from a collagen sheet split from a fresh bovine hide; where the collagen sheet has been at least one of macerated or dried.

2. The fresh bovine hide raw material product of claim 1, wherein the fresh bovine hide raw material product has no calcium residue added from a liming process.

3. The fresh bovine hide raw material product of claim 1, wherein the fresh bovine hide raw material product has a sulfur residue of less than 0.33% by total wet weight.

4. The fresh bovine hide raw material product of claim 3, wherein the fresh bovine hide raw material product has no sulfur residue added from a at least one of a liming or a beaming process.

5. The fresh bovine hide raw material product of claim 1, wherein the fresh bovine hide raw material product has non-measurable trace amounts of sodium by total weight.

6. The fresh bovine hide raw material product of claim 5, wherein the fresh bovine hide raw material product has no sodium residue added from at least one of a liming or beaming process.

7. The fresh bovine hide raw material product of claim 1, wherein the macerated collagen sheet has been dried; wherein the collagen sheet has been macerated after being dried.

8. The fresh bovine hide raw material product of claim 1, wherein the macerated collagen sheet has been dried; wherein the macerated collagen sheet has been dried a second time.

9. The fresh bovine hide raw material product of claim 1, wherein the macerated collagen sheet has been macerated and dried; wherein the collagen sheet has been macerated prior to being dried.

10. The fresh bovine hide raw material product of claim 1, wherein the collagen sheet has been dried for between six and sixteen hours.

11. The fresh bovine hide raw material product of claim 10, wherein the collagen sheet has been dried for between twelve and fifteen hours.

12. The fresh bovine hide raw material product of claim 10, wherein the collagen sheet has been dried for eight hours.

13. The fresh bovine hide raw material product of claim 1, wherein the water activity of the fresh bovine hide raw material product is less than 0.5.

14. The fresh bovine hide raw material product of claim 1, wherein the collagen sheet has been split from a top grain of the fresh bovine hide; wherein the top grain includes a thickness of between 0.50 and 5.50 mm.

15. The fresh bovine hide raw material product of claim 1, wherein the water activity of the fresh bovine hide raw material product is between 0.25 and 0.26.

16. The fresh bovine hide raw material product of claim 1, comprising a pH between 6 and 8.

17. The fresh bovine hide raw material product of claim 1, wherein the collagen sheet comprises a corium layer.

18. The fresh bovine hide raw material product of claim 1, wherein the fresh bovine hide is from a bovine in a family Bovidae.

19. The fresh bovine hide raw material product of claim 1, wherein the fresh bovine hide raw material product is used to produce a slurry.

20. The fresh bovine hide raw material product of claim 19, wherein a gelatin is extracted from the slurry.

* * * * *